US009158240B2

(12) United States Patent
Doshida et al.

(10) Patent No.: US 9,158,240 B2
(45) Date of Patent: Oct. 13, 2015

(54) IMAGE FORMING APPARATUS THAT PREVENTS SURFACE SPEED DIFFERENCE FROM BEING GENERATED BETWEEN PHOTOSENSITIVE DRUM AND INTERMEDIATE TRANSFER BELT

(71) Applicant: CANON KABUSHIKI KAISHA, Tokyo (JP)

(72) Inventors: Takaaki Doshida, Moriya (JP); Toshinori Kimura, Chikusei (JP)

(73) Assignee: CANON KABUSHIKI KAISHA (JP)

( * ) Notice: Subject to any disclaimer, the term of this patent is extended or adjusted under 35 U.S.C. 154(b) by 0 days.

(21) Appl. No.: 14/107,537

(22) Filed: Dec. 16, 2013

(65) Prior Publication Data

US 2014/0169831 A1 Jun. 19, 2014

(30) Foreign Application Priority Data

Dec. 17, 2012 (JP) ..... 2012-274575
Dec. 21, 2012 (JP) ..... 2012-279466

(51) Int. Cl.
*G03G 15/16* (2006.01)
*G03G 15/00* (2006.01)

(52) U.S. Cl.
CPC ..... *G03G 15/167* (2013.01); *G03G 15/1615* (2013.01); *G03G 15/757* (2013.01)

(58) Field of Classification Search
CPC . G03G 15/167; G03G 15/1615; G03G 15/50; G03G 15/505; G03G 15/5008; G03G 15/757; G03G 2215/0129
USPC ..... 399/167, 302, 308, 301
See application file for complete search history.

(56) References Cited

U.S. PATENT DOCUMENTS

| | | | | |
|---|---|---|---|---|
| 6,556,798 | B2 | 4/2003 | Rimai et al. | |
| 2007/0280734 | A1 * | 12/2007 | Yahagi | 399/167 |
| 2009/0297222 | A1 * | 12/2009 | Kawamura | 399/167 |
| 2011/0026969 | A1 * | 2/2011 | Maeda | 399/167 |
| 2013/0016987 | A1 * | 1/2013 | Imai | 399/167 X |

FOREIGN PATENT DOCUMENTS

JP 2002-333752 A 11/2002

* cited by examiner

*Primary Examiner* — Sophia S Chen
(74) *Attorney, Agent, or Firm* — Rossi, Kimms & McDowell LLP

(57) ABSTRACT

An image forming apparatus capable of preventing image defects, such as color shift, from being caused, by preventing increased transfer pressure from being applied by a primary transfer section to thereby prevent a surface speed difference from being generated between the photosensitive drum and the intermediate transfer belt. The image forming apparatus includes a photosensitive drum and an intermediate transfer belt that rotates in contact with the photosensitive drum, respective brushless DC motors for driving the photosensitive drum for rotation and the intermediate transfer belt for rotation, and a controller for controlling the brushless DC motors. The controller performs control such that the brushless DC motor applies assist torque to the photosensitive drum, for offsetting load torque acting thereon, thereby enabling the photosensitive drum to be friction-driven by the intermediate transfer belt.

22 Claims, 19 Drawing Sheets

IMAGE FORMING APPARATUS THAT PREVENTS SURFACE SPEED DIFFERENCE FROM BEING GENERATED BETWEEN PHOTOSENSITIVE DRUM AND INTERMEDIATE TRANSFER BELT

BACKGROUND OF THE INVENTION

1. Field of the Invention

The present invention relates to an electrophotographic image forming apparatus, such as a copy machine, a multifunction peripheral, and a facsimile machine, in which a toner image formed on an image bearing member is transferred onto an intermediate transfer member.

2. Description of the Related Art

Conventionally, an electrophotographic image forming apparatus, which is applied to a copy machine, a multifunction peripheral, a facsimile machine, etc., has a photosensitive drum (image bearing member) which carries a toner image thereon, and an intermediate transfer belt (intermediate transfer member). It is demanded by the market that the photosensitive drum and the intermediate transfer belt are driven such that surface speeds thereof are both constant.

This is because, first, in a case where time-synchronized exposure is employed as laser exposure for forming an electrostatic latent image on the photosensitive drum, variation in the surface speed of the photosensitive drum causes deviation of a laser irradiation position on the photosensitive drum from an original proper position thereon to be irradiated. Secondly, also in a process for transferring a toner image formed on the photosensitive drum onto the intermediate transfer belt (primary transfer), if there occurs an AC current-like variation in the difference of surface speed between the photosensitive drum and the intermediate transfer belt, the position of the toner image which is to be transferred onto the intermediate transfer belt deviates from the original proper position on which the toner image is to be transferred. This causes image defects on an image transferred onto a recording sheet, which are called color shift (positional displacement between respective colors) and banding (periodic positional displacement).

To overcome the above-mentioned problem, in driving the photosensitive drum and the intermediate transfer belt, a CPU performs feedback-control of the speed of a motor as a drive source, using a suitable one of various speed detection sensors and the like to thereby ensure highly-accurate speed constancy. As a drive motor, one employing a brushless DC motor (hereinafter referred to as the "BLDC motor") is often used because of low-cost, quietness, and high efficiency.

Further, in recent years, as the speed feedback control using the BLDC motor, there is an example employing a method in which, for example, a rotary encoder is arranged on a drum shaft, and the CPU controls the BLDC motor to rotate the drum shaft at a constant speed.

However, in the above-mentioned speed feedback control, the CPU keeps track of the rotational speed of the drum shaft, but it does not keep track of the surface speed of the photosensitive drum. Therefore, it is difficult to control the surface speed of the photosensitive drum to a constant speed e.g. due to off-centering of the drum shaft and an error in accuracy of the diameter of the photosensitive drum. Such is also the case with the intermediate transfer belt, and the intermediate transfer belt suffers from the same problem e.g. due to off-centering of a shaft of a drive roller which drives the intermediate transfer belt, an error in accuracy of the diameter of the drive roller, and variation in thickness of the intermediate transfer belt.

Further, causes of the image defects include mutual interference caused by friction between the surface of the photosensitive drum and the transfer surface of the intermediate transfer belt. This is a problem that a speed variation occurring in one of the photosensitive drum and the intermediate transfer belt is transmitted to the other to have influence thereon.

In addition to these causes, as another cause, there may be mentioned an occurrence of a sporadic change in load on the intermediate transfer belt during transfer of a toner image carried on the intermediate transfer belt onto a recording sheet (secondary transfer), especially when the recording sheet is thick paper. This causes a high-frequency speed variation, and this speed variation may cause positional displacement in the primary transfer.

As described above, there are various causes of the image defects, and it is very difficult to eliminate all of the causes. To cope with this, as described in Japanese Patent Laid-Open Publication No. 2002-333752, there has been developed a technique in which an image transfer barrel (which corresponds to an intermediate transfer belt) causes an image barrel (which corresponds to a photosensitive drum) to be driven by friction therebetween (friction-driven).

This has the following merits: First, images on the photosensitive drums are transferred to form an image on the intermediate transfer belt, and hence by forming the image on the intermediate transfer belt with reference to respective positions on the photosensitive drums, the influence of irregular rotation of the photosensitive drums is offset. Further, secondly, even when the speed of the intermediate transfer belt is varied e.g. due to an impact generated upon entrance of a recording sheet into a secondary transfer section of the intermediate transfer belt, coincidence of respective images on the photosensitive drums and an image on the intermediate transfer belt can be ensured, which makes image defects difficult to be caused by the primary transfer.

However, as described in Japanese Patent Laid-Open Publication No. 2002-333752, to cause each photosensitive drum to be friction-driven in a proper fashion (without occurrence of a slip) by the intermediate transfer belt using a frictional force between the photosensitive drum and the intermediate transfer belt, it is required to increase transfer pressure applied by an associated primary transfer section. If transfer pressure applied by the primary transfer section is increased, load generated on the photosensitive drum and the intermediate transfer belt is increased, resulting in an increase in drive torque. This brings about a problem that a surface speed difference is likely to be generated between each photosensitive drum and the intermediate transfer belt, which causes image defects, such as color shift.

SUMMARY OF THE INVENTION

The present invention provides an image forming apparatus that is capable of preventing image defects, such as color shift, from being caused, by preventing increased transfer pressure from being applied by a primary transfer section to thereby prevent a surface speed difference from being generated between the photosensitive drum and the intermediate transfer belt.

In a first aspect of the present invention, there is provided an image forming apparatus comprising an image bearing member configured to be rotatable, an intermediate transfer member configured to be rotatable in contact with the image bearing member, a first drive unit configured to drive the image bearing member for rotation, a second drive unit configured to drive the intermediate transfer member for rotation, and a control unit configured to control the first drive unit and the second drive unit, wherein the control unit performs control such that the first drive unit is caused to apply torque to the image bearing member, for offsetting load torque acting on the image bearing member, to thereby cause the image bearing member to be friction-driven by the intermediate transfer member.

In a second aspect of the present invention, there is provided an image forming apparatus comprising an image bearing member configured to be rotatable, an intermediate transfer member configured to rotatable in contact with the image bearing member, a first drive unit configured to drive the image bearing member for rotation, a second drive unit configured to drive the intermediate transfer member for rotation, and a control unit configured to control the first drive unit and the second drive unit, wherein the control unit performs control such that the second drive unit is caused to apply torque to the intermediate transfer member, for offsetting load torque acting on the intermediate transfer member, to thereby cause the intermediate transfer member to be friction-driven by the image bearing member.

According to the present invention, it is possible to prevent image defects, such as color shift, from being caused, by preventing increased transfer pressure from being applied by a primary transfer section to thereby prevent a surface speed difference from being generated between the photosensitive drum and the intermediate transfer belt.

Further features of the present invention will become apparent from the following description of exemplary embodiments with reference to the attached drawings.

DESCRIPTION OF THE EMBODIMENTS

The present invention will now be described in detail below with reference to the accompanying drawings showing embodiments thereof.

Figure 1:
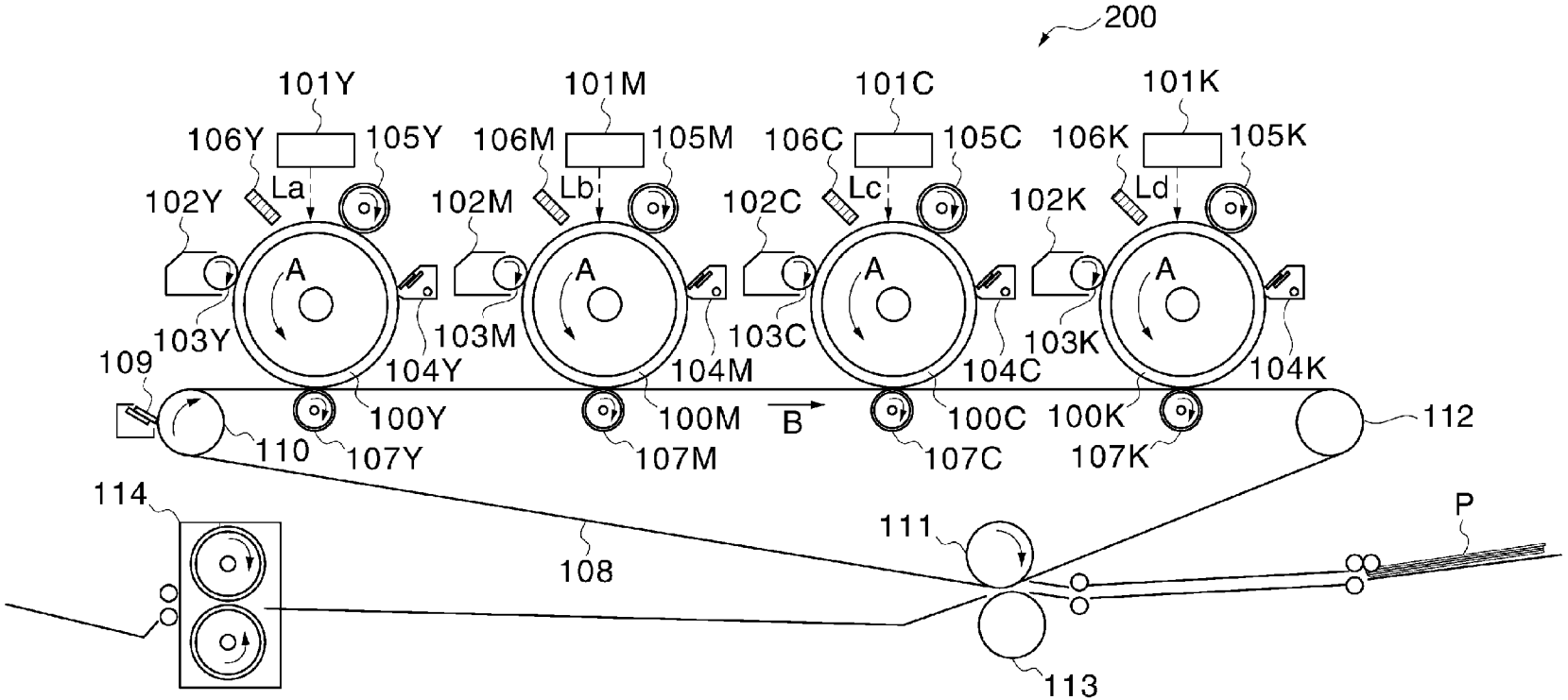
FIG. 1 is a schematic cross-sectional view of essential parts of an image forming apparatus according to a first embodiment of the present invention.

FIG. 1 is a schematic cross-sectional view of essential parts of an image forming apparatus according to a first embodiment of the present invention.

The image forming apparatus, denoted by reference numeral 200, is an electrophotographic color digital copy machine. The image forming apparatus 200 is not necessarily required to be a copy machine but may also be a multifunction peripheral or a facsimile machine, and further may be not only a color machine but also a monochrome digital copy machine, multifunction peripheral or facsimile machine. In short, any suitable image forming apparatus may be employed insofar as it is configured to transfer a toner image formed on an image bearing member onto an intermediate transfer member.

Referring to FIG. 1, a plurality of, e.g. four image forming units respectively including photosensitive drums 100Y, 100M, 100C, and 100K, which are associated with colors of yellow (Y), magenta (M), cyan (C), and black (K), respectively, are arranged substantially in the horizontal direction. Component elements are the same between the image forming units, and hence hereinafter, when the component elements are not differentiated from each other in association with respective image forming units, the same reference numerals are used, whereas when the component elements are differentiated, Y, M, C, or K is attached to each of the reference numerals. The photosensitive drums 100Y to 100K as the image bearing members are rotatable, and rotate in a direction indicated by respective arrows A in FIG. 1.

The image forming units include not only the photosensitive drums 100Y to 100K, but also electrostatic charging rollers 105Y, 105M, 105C, and 105K, exposure devices 101Y, 101M, 101C, and 101K, and developing devices 102Y, 102M, 102C, and 102K, respectively. The developing devices 102Y to 102K include developing sleeves 103Y, 103M, 103C, and 103K, respectively. The image forming units further include cleaners 104Y, 104M, 104C, and 104K, associated with the photosensitive drums 100Y to 100K, respectively, and surface position-detecting sections 106Y, 106M, 106C, and 106K for detecting surface positions on the photosensitive drums 100Y to 100K, respectively.

The electrostatic charging rollers 105Y to 105K uniformly electrostatically charge the surfaces of the photosensitive drums 100Y to 100K, respectively. Further, the exposure devices 101Y to 101K expose the electrostatically charged surfaces of the photosensitive drums 100Y to 100K based on image information to thereby form electrostatic latent images thereon, respectively.

The developing devices 102Y to 102K develop the electrostatic latent images formed on the surfaces of the respective photosensitive drums 100Y to 100K using the developing sleeves 103Y to 103K, each containing toner of an associated one of chromatic colors, to thereby form toner images, respectively.

Primary transfer rollers 107Y, 107M, 107C, and 107K are disposed at respective locations opposed to the photosensitive drums 100Y to 100K. An endless intermediate transfer belt (hereinafter referred to as the "intermediate transfer belt") 108 as the intermediate transfer member is stretched such that it is conveyed through between the photosensitive drums 100Y to 100K and the primary transfer rollers 107Y to 107K.

The intermediate transfer belt 108 is stretched around a drive roller 110, a secondary transfer backup roller 111, and a tension roller 112, and rotates in a state brought into contact with the surfaces of the photosensitive drums 100Y to 100K. The intermediate transfer belt 108 moves in a direction indicated by an arrow B in FIG. 1. The toner images of the respective colors formed on the photosensitive drums 100Y to 100K are sequentially transferred onto the intermediate transfer belt 108 in superimposed relation to thereby form a color image.

The drive roller 110 drives the intermediate transfer belt 108, and also functions as a tension roller for controlling tension of the intermediate transfer belt 108 such that it is constant. The secondary transfer backup roller 111 and a secondary transfer roller 113 disposed at a location opposed to the secondary transfer backup roller 111 form a nip therebetween.

The toner image on the intermediate transfer belt 108 is transferred onto a recording sheet P by a secondary transfer roller pair (secondary transfer section) formed by the secondary transfer backup roller 111 and the secondary transfer roller 113, and the recording sheet P having the toner image transferred thereon is conveyed into a fixing device 114 disposed at a location downstream of the secondary transfer roller pair. The toner image is fixed on the recording sheet P by the fixing device 114, and the recording sheet P is discharged out of the apparatus. On the other hand, after the secondary transfer has been performed, remaining toner, paper dust, and the like are cleaned from the intermediate transfer belt 108 by an intermediate transfer belt cleaner 109, whereby the intermediate transfer belt 108 is repeatedly used in the image formation process.

The image formation process for forming an image on a sheet, executed by the image forming apparatus 200 having the above-described configuration, will be described. When a host CPU 10 (see FIG. 2) which controls the overall operation of the image forming apparatus 200 receives an instruction for forming an image on the recording sheet P, the photosensitive drums 100 and the intermediate transfer belt 108 start to be rotated. At the same time, the electrostatic charging rollers 105, the developing sleeves 103 of the developing devices 102, the primary transfer rollers 107, the secondary transfer backup roller 111 of the secondary transfer section, and fixing rollers of the fixing device 114 start to be rotated.

The electrostatic charging rollers 105 are each connected to a high-voltage power supply, not shown, and have a high voltage applied thereto which is formed by DC voltage or DC voltage having a sinusoidal voltage superposed thereon. This causes the surfaces of the photosensitive drums 100, which are brought into contact with the electrostatic charging rollers 105, to be uniformly charged to the same potential as that of the DC voltage applied from the high-voltage power supply.

Next, the electrostatically charged surfaces of the photosensitive drums 100 sequentially reach irradiation positions of laser beams (La, Lb, Lc, and Ld) from the exposure devices 101, respectively, and are exposed by the exposure devices 101 according to image signals. As a result, electrostatic latent images are formed on the photosensitive drums 100, respectively.

Thereafter, in the developing devices 102, a high voltage generated by superposing a rectangular voltage on the DC voltage is applied from a high-voltage power source, not shown, to the developing sleeves 103. Negatively charged toner is sequentially supplied from the developing sleeves 103 to the electrostatic latent images on the photosensitive drums 100Y to 100K at potentials more positive than that of the developing sleeves 103 and more negative than ground, whereby toner images are formed thereon. Each developing sleeve 103 is rotated in a clockwise direction as viewed in FIG. 1.

The toner images on the four photosensitive drums 100 are sequentially transferred onto the intermediate transfer belt 108 by the respective primary transfer rollers 107 in superimposed relation (primary transfer) to thereby form a color image on the intermediate transfer belt 108. The color image on the intermediate transfer belt 108 is transferred onto the recording sheet P by the secondary transfer backup roller 111 and the secondary transfer roller 113 (secondary transfer). Note that high DC voltages for transferring toner images and a color image are also applied from high-voltage power supplies, not shown, to the primary transfer rollers 107 and the secondary transfer roller 113, respectively.

Residual toner remaining on the photosensitive drums 100 is scraped and collected by the cleaners 104. Residual toner remaining on the intermediate transfer belt 108 is scraped and collected by the intermediate transfer belt cleaner 109. The color image transferred onto the recording sheet P is fixed on the recording sheet P with high pressure and high temperature by the fixing device 114. The description given above is a simplified explanation of the image formation process.

Next, the arrangement for driving the photosensitive drums 100 and the intermediate transfer belt 108 will be described. The present image forming apparatus is configured such that for image formation, the intermediate transfer belt 108 is operated at a constant surface speed in a state brought into contact with the photosensitive drums 100, and the intermediate transfer belt 108 causes the photosensitive drums 100 to be friction-driven by a frictional force generated between the photosensitive drums 100 and the intermediate transfer belt 108.

Figure 2:
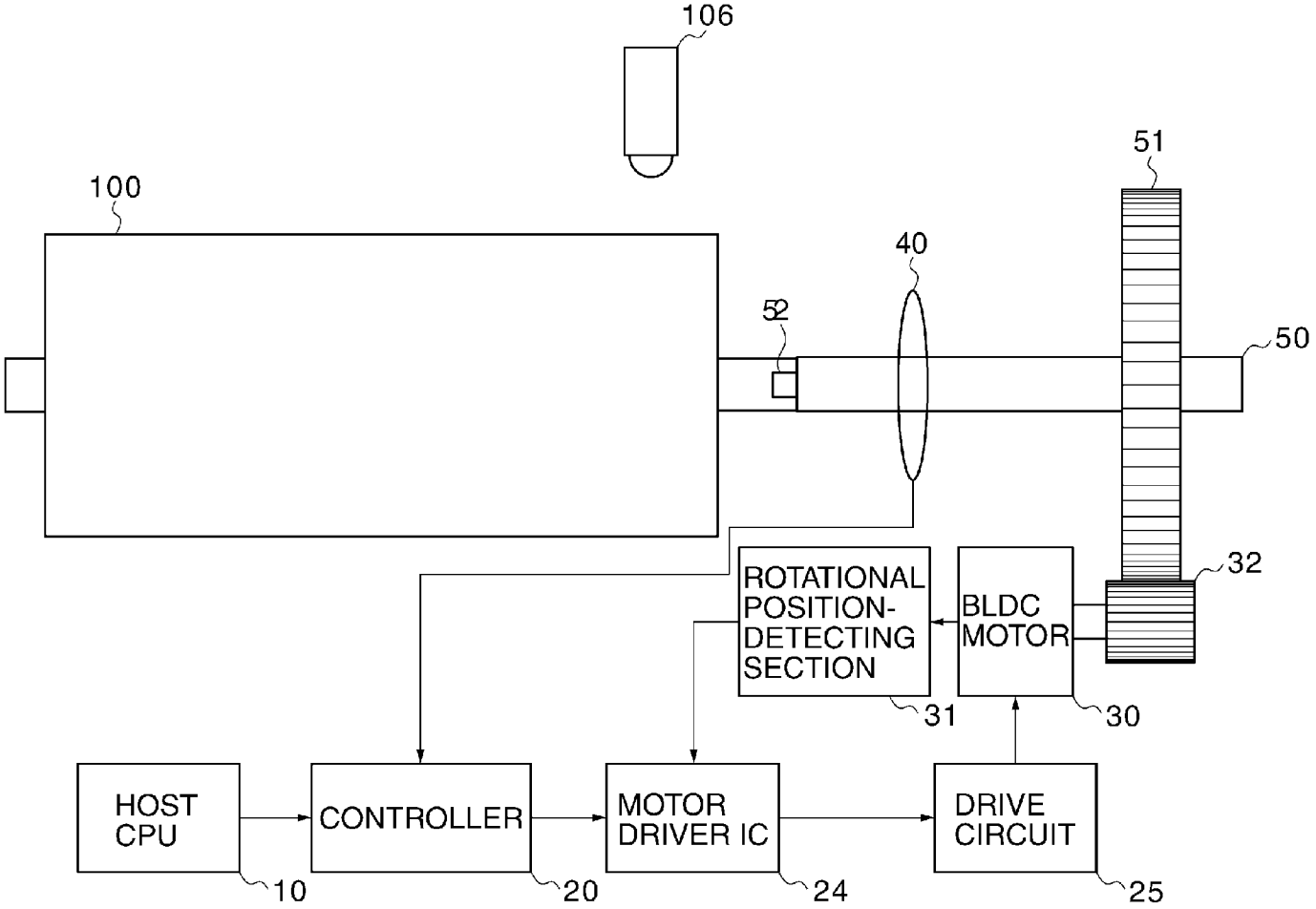
FIG. 2 is a schematic diagram showing the electrical and mechanical arrangement for driving a photosensitive drum.

FIG. 2 is a schematic diagram showing the electrical and mechanical arrangement for driving the photosensitive drums 100. Each photosensitive drum 100 is concentrically and mechanically connected to a drum shaft 50 via a coupling 52. Further, a reduction gear 51 and a rotary encoder 40 are fixedly fitted on the drum shaft 50. The rotary encoder 40 (speed detection unit) detects a rotational speed of the drum shaft 50.

A drive force from a brushless DC motor (hereinafter referred to as the "BLDC motor") 30 of a low-inertia type, which is a first drive unit, is transmitted to the drum shaft 50 by engagement of a motor shaft gear 32 with the reduction gear 51. Therefore, the drum shaft 50 is rotated at a speed which is obtained by reducing the rotational speed of the BLDC motor 30 by the reduction gear 51. In short, the BLDC motor 30 drives the drum shaft 50 for rotation via the motor shaft gear 32 and the reduction gear 51. A controller 20 delivers various control signals (a drive on/off control signal, a PWM signal, etc.) to a motor driver IC 24 according to command signals (a drive on/off signal, a target speed signal, a register set value signal, a PWM value signal, etc.) received from the host CPU 10. Further, the controller 20 performs operations for the speed control based on a signal output from the rotary encoder 40.

Note that the PWM signal is a pulse width modulation signal, and a duty ratio thereof is defined as a value obtained by dividing a high-level duration of the signal by one repetition period of the signal. The value of the duty ratio is expressed as a percentage. The duty ratio is proportional to the torque of the BLDC motor 30.

Although details will be described hereinafter, conventionally, it has been a widely-employed practice to perform speed feedback control in which the duty ratio for driving the image bearing member for rotation is adjusted such that the surface speed of the image bearing member becomes equal to a sheet feed speed (hereinafter referred to as the "target speed") of a recording sheet. However, in the present embodiment, such speed feedback control is not performed for the photosensitive drums 100, but the photosensitive drums 100 is driven for rotation by inputting a predetermined fixed duty ratio to the motor driver IC 24.

A rotational position-detecting section 31 detects a rotational position of the BLDC motor 30. According to a control signal output from the controller 20 and a rotational position signal output from the rotational position-detecting section 31, the motor driver IC 24 switches the phase currents to be supplied to the BLDC motor 30 and adjusts the current amounts of the same, via a drive circuit 25.

Figure 3:
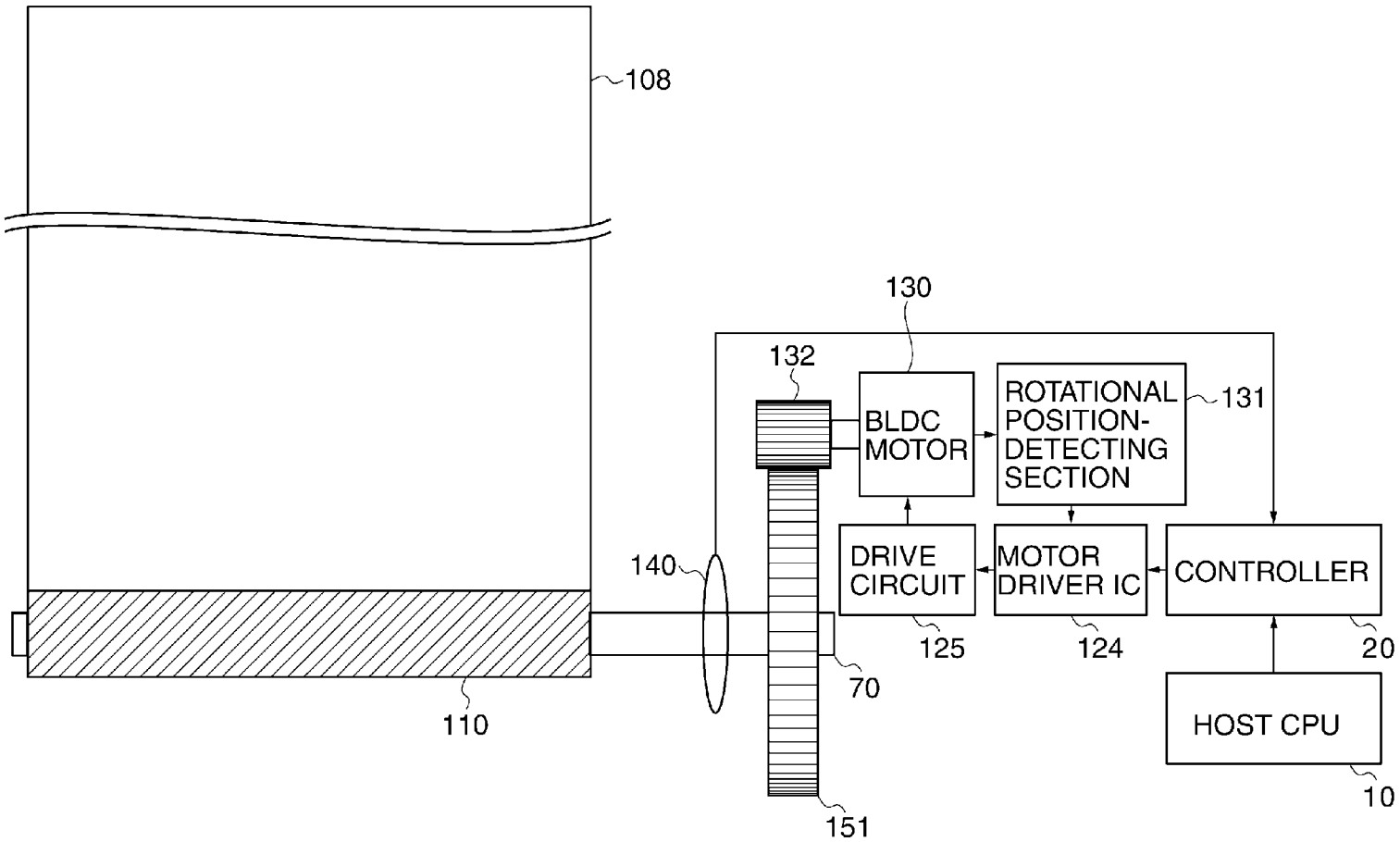
FIG. 3 is a schematic diagram showing the electrical and mechanical arrangement for driving an intermediate transfer belt.

FIG. 3 is a schematic diagram showing the electrical and mechanical arrangement for driving the intermediate transfer belt 108. The drive roller 110 is disposed such that it is in contact with an inner side of the intermediate transfer belt 108 (see also FIG. 2). The intermediate transfer belt 108 is driven for rotation by the rotation of the drive roller 110.

The drive roller 110 is concentrically and mechanically connected to a drive roller shaft 70. A reduction gear 151 and a rotary encoder 140 are fixedly fitted on the drive roller shaft 70. The rotary encoder 140 (speed detection unit) detects a rotational speed of the drive roller shaft 70.

A drive force from a BLDC motor 130 which is a second drive unit is transmitted to the drive roller shaft 70 by engagement of a motor shaft gear 132 with the reduction gear 151. Therefore, similar to the photosensitive drums 100, the drive roller shaft 70 is rotated at a speed which is obtained by reducing the rotational speed of the BLDC motor 130 by the reduction gear 151.

The controller 20 receives command signals (a drive on/off signal, a register set value signal, etc.) from the host CPU 10, and outputs various control signals (a drive on/off signal, a PWM signal, etc.) to a motor driver IC 124.

A rotational position-detecting section 131 detects a rotational position of the BLDC motor 130. The motor driver IC 124 switches the phase currents to be supplied to the BLDC motor 130 and adjusts the current amounts of the same, via a drive circuit 125, based on a control signal from the controller 20 and a rotational position signal output from the rotational position-detecting section 131.

The controller 20 performs calculation for surface speed control for the intermediate transfer belt 108 based on a signal output from the rotary encoder 140. Differently from the control for the photosensitive drums 100, the controller 20 performs the speed feedback control such that the surface speed of the intermediate transfer belt 108 becomes equal to a constant target speed. Note that in the electrical configuration, a component element for detecting the surface position of the intermediate transfer belt 108, corresponding to the surface position-detecting section 106, is not essential, and hence is not provided.

Figure 4:
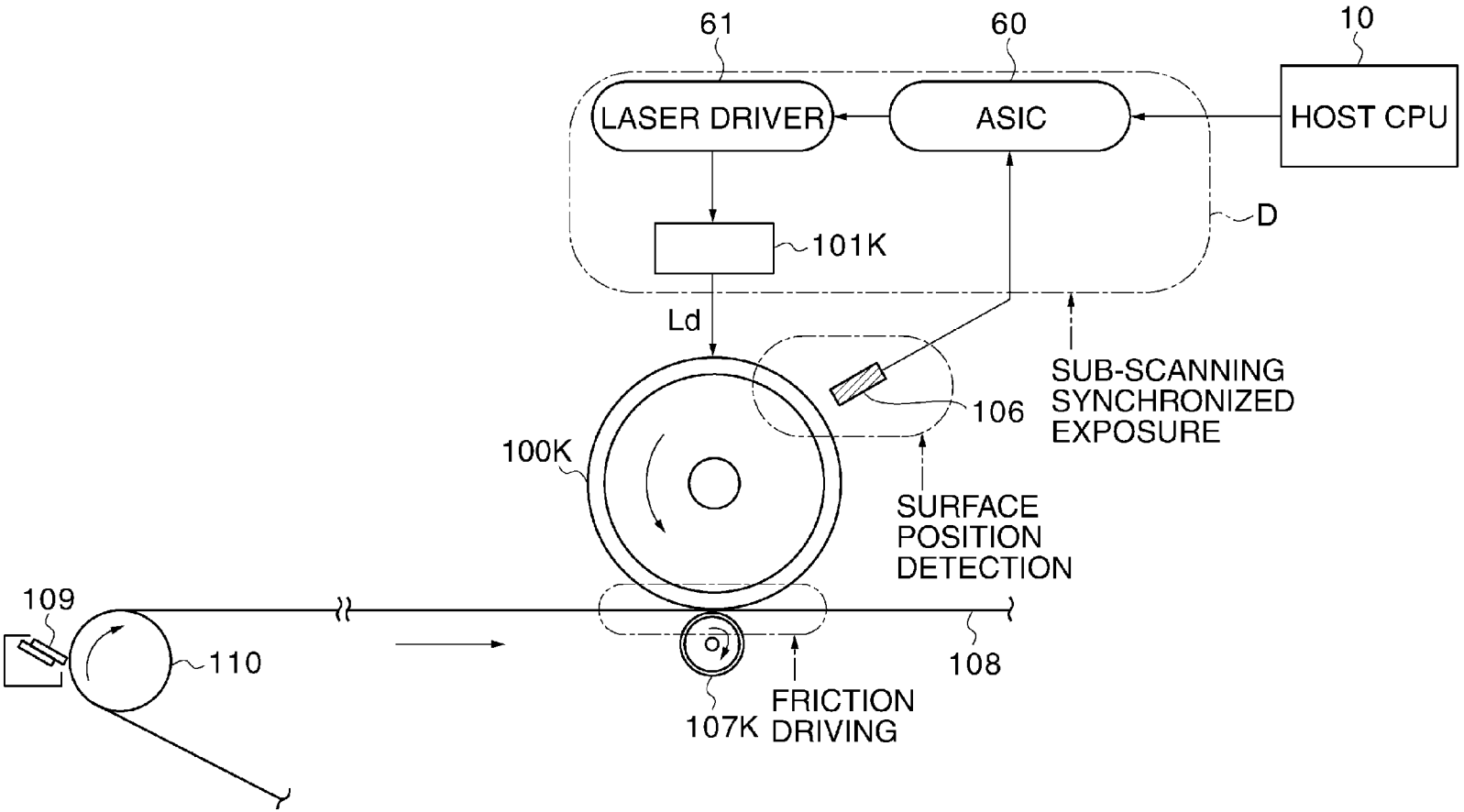
FIG. 4 is a schematic diagram of a cross-section of the photosensitive drum and the intermediate transfer belt.

Next, a friction drive system in which the photosensitive drums 100 are friction-driven by the intermediate transfer belt 108 will be described with reference to FIG. 4. FIG. 4 is a schematic diagram of a cross-section of the photosensitive drum 100 and the intermediate transfer belt 108, useful in explaining the friction drive system as well as exposure control. In FIG. 4, the component elements associated with black (K) are illustrated as a representative example.

A sub-scanning synchronized exposure section D includes the exposure device 101K, an ASIC (Application Specific Integrated Circuit) 60, and a laser driver 61. The sub-scanning synchronized exposure section D is controlled by the host CPU 10.

The photosensitive drum 100K is driven for rotation under the control (described hereinafter) of the controller 20 in such a manner that the surface speed follows the surface speed of the intermediate transfer belt 108. The sub-scanning synchronized exposure section D performs exposure by the exposure device 101K (sub-scanning synchronized exposure) in synchronism with the surface position on the photosensitive drum 100K, detected by the surface position-detecting section 106K, to thereby form an electrostatic latent image on the photosensitive drum 100K.

The same control is performed for the other photosensitive drums 100 (Y, M, and C). Although main techniques used here are friction driving, surface position detection, and sub-scanning synchronized exposure, methods of implementing these techniques will be specifically described hereafter, and particularly, the friction driving deeply related to the present invention will be described in detail.

The friction drive system according to the present embodiment is configured such that the photosensitive drums 100 are friction-driven for rotation by the intermediate transfer belt 108, using a frictional force generated between the surface of the intermediate transfer belt 108 and the surface of each photosensitive drum 100. Particularly, to achieve proper image transfer without positional displacement, it is necessary to perform control in image formation such that the surface speed of the intermediate transfer belt 108 and that of the photosensitive drums 100 are always equal to each other so as to prevent a slip from occurring between the intermediate transfer belt 108 and the photosensitive drums 100.

As described above, the intermediate transfer belt 108 is controlled by the speed feedback control performed by the controller 20 such that it rotates at a constant surface speed. On the other hand, the photosensitive drums 100 are driven by the BLDC motor 30 at a predetermined duty ratio according to the control of the controller 20.

In general, the duty ratio has a linear relationship with the magnitude of necessary torque during stable rotation of the motor and is uniquely determined. This is because, first, the duty ratio represents a time period during which the applied voltage is on, and the motor driver IC 24 supplies electric current to the motor for the time period (although different depending on a motor driver IC, the duty ratio sometimes represents a time period during which the applied voltage is off), which makes the duty ratio and the electric current proportional to each other. Further, the BLDC motor 30 used in this example and a brush DC motor are excellent in a linear relationship between electric current and torque, and hence the duty ratio and torque also have a linear relationship.

In the present embodiment, besides making use of the frictional force generated by the intermediate transfer belt 108, by adjusting torque for driving each photosensitive drum 100 for rotation, proper friction driving is realized. Torque generated by the BLDC motor 30 for rotation of the photosensitive drum 100 with a view to realizing the proper friction driving is hereinafter referred to as the "assist torque". Therefore, the assist torque is a design parameter, and the value of the parameter can be changed by the duty ratio. A torque command value, referred to hereinafter, is a command value that designates a value of the duty ratio.

Figure 5:
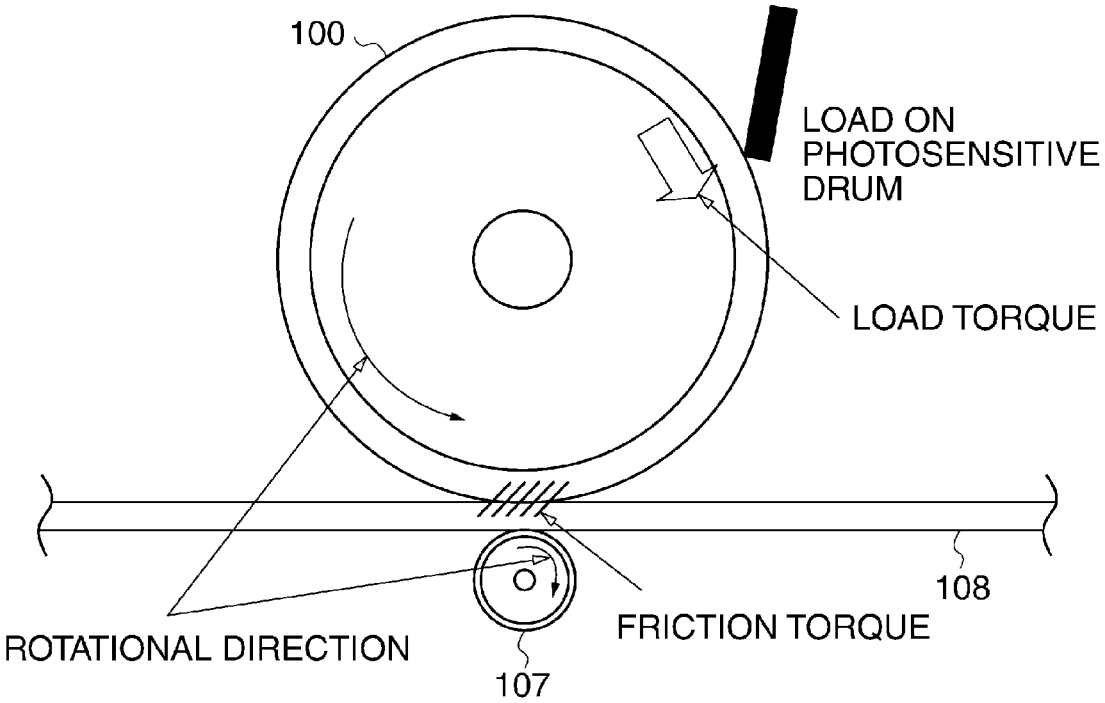
FIG. 5 is a diagram useful in explaining load torque applied to the photosensitive drum and friction torque generated by contact between the photosensitive drum and the intermediate transfer belt.

FIG. 5 is a diagram useful in explaining load torque generated on each photosensitive drum 100 and friction torque generated by contact between the photosensitive drum 100 and the intermediate transfer belt 108.

Note that the load torque is a combined total of load torques generated on the cleaner 104, a bearing of the drum shaft 50, etc., during rotating operation of the photosensitive drum 100 in the image formation process. The load torque does not include photosensitive drum-intermediate transfer belt friction torque (hereinafter referred to as the "friction torque") generated between the contact surfaces of the photosensitive drum 100 and the intermediate transfer belt 108.

Figure 6:
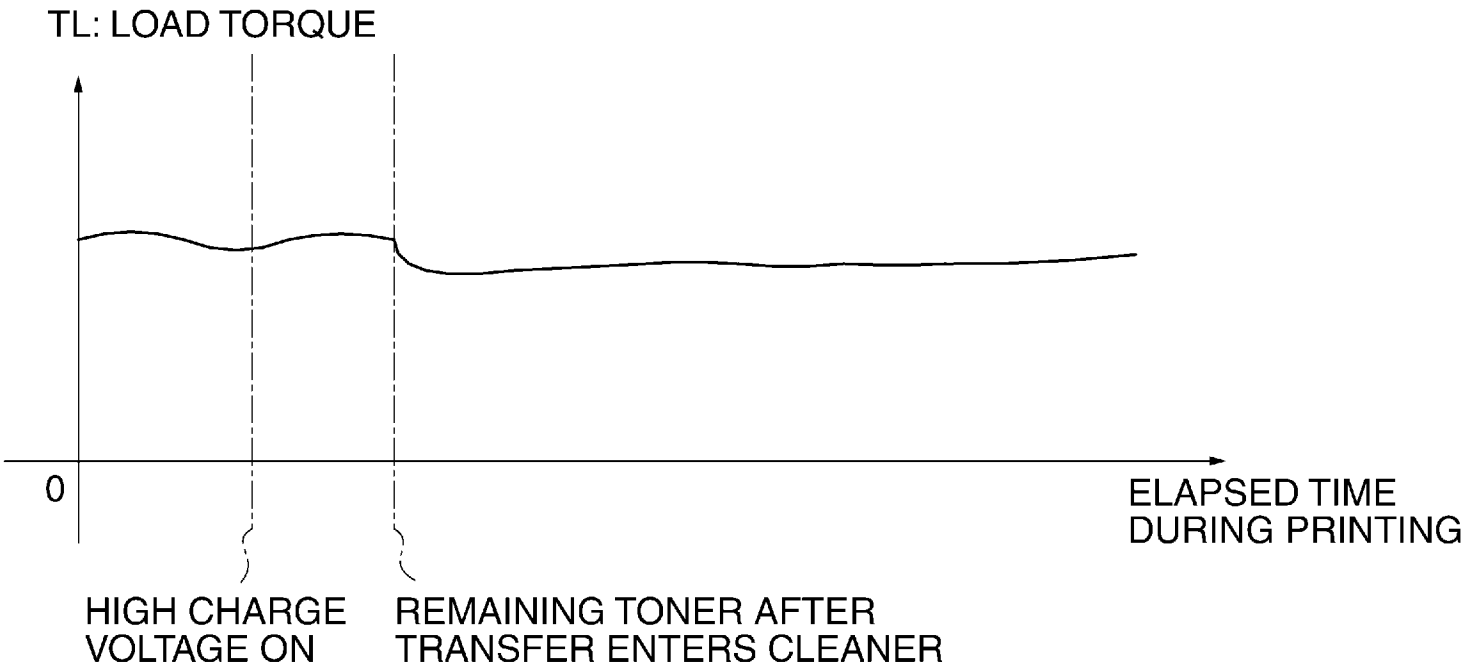
FIG. 6 is a diagram showing changes in load torque during an image formation process.
Figure 7:
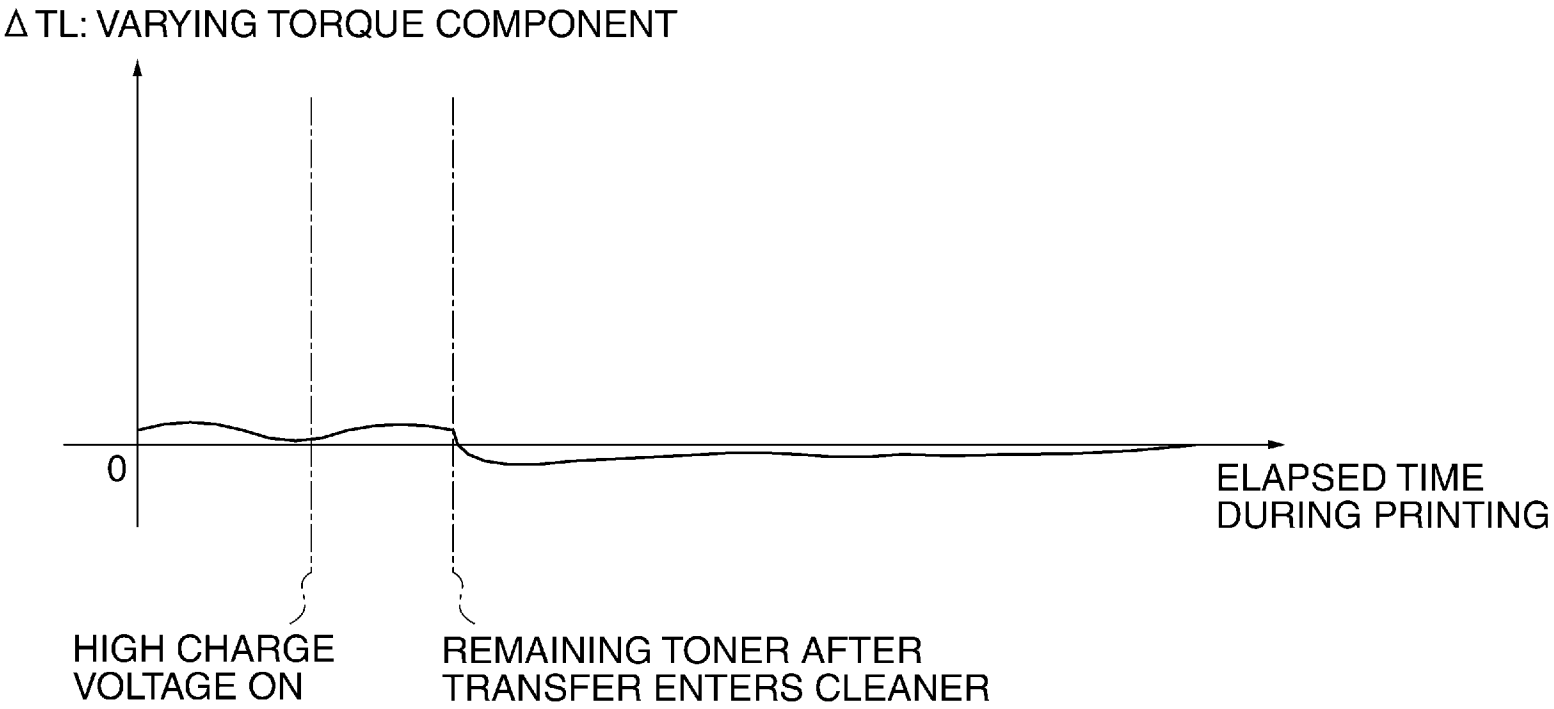
FIG. 7 is a diagram showing changes in a variation torque component of load torque obtained by offsetting a constant component of load torque by assist torque, during the image formation process.
Figure 8:
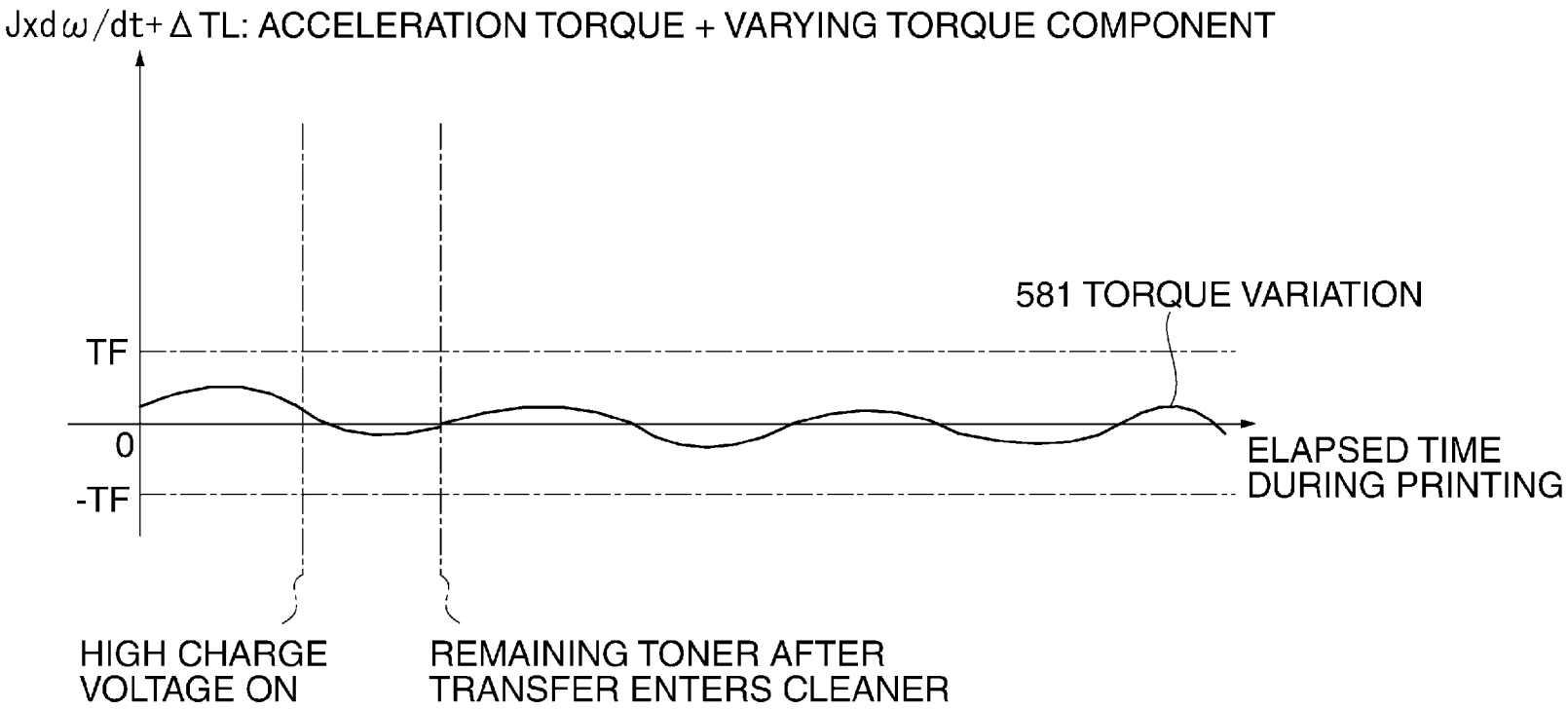
FIG. 8 is a diagram showing changes in load torque as the sum of acceleration torque and the variation torque component during the image formation process.

FIGS. 6 to 8 are diagrams useful in explaining changes in the load torque in the image formation process.

As shown in FIG. 6, the load torque is not always constant, but changes depending on a timing at which a high charge voltage is applied and a timing at which remaining toner which has not been transferred enters the cleaner 104. That is, the load torque generated when the photosensitive drum 100 is rotated is composed of a constantly-generated load torque (constant component) and a transient varying component (hereinafter referred to as the "varying torque component"). However, it is known that the above-mentioned varying torque component is sufficiently small compared with the constant component.

Further, the constant component of the load torque is much larger than the friction torque which is normally set, and hence the intermediate transfer belt 108 cannot cause the photosensitive drums 100 to be driven only by friction torque. To cope with this, in the present embodiment, the BLDC motor 30 applies torque corresponding to the constant component of the load torque to the photosensitive drums 100 as the assist torque, so as to offset the constant component of the load torque.

By applying the assist torque, the resulting load torque on the photosensitive drum 100 becomes equal to the varying torque component as shown in FIG. 7, which indicates that it is made easy to cause the photosensitive drum 100 to be driven by friction torque. That is, FIG. 7 is a diagram showing a state of the load torque generated on the photosensitive drum 100 shown in FIG. 5 in which the constant component thereof is offset by the assist torque. Since the constant component of the load torque is offset by the assist torque applied to each photosensitive drum 100, only the varying torque component actually acts on the photosensitive drum 100.

As described above, by offsetting the constant component of the load torque by the assist torque, the varying torque component, which is the resulting actual load torque component, becomes smaller than the friction torque acting on the contact surfaces of the photosensitive drum 100 and the intermediate transfer belt 108. As a result, each photosensitive drum 100 can be driven in synchronism with the speed variation of the intermediate transfer belt 108.

Further, to cause the photosensitive drum 100 to be friction-driven in a manner following the speed variation of the intermediate transfer belt 108, it is necessary to take into account "acceleration torque" expressed by multiplication of drum inertia (inertia) of the drum shaft 50 and acceleration. As shown in FIG. 8, if a value obtained by adding up the acceleration torque and the varying torque component of the photosensitive drum 100 is not larger than a value of friction torque, it is possible to cause the photosensitive drum 100 to be friction-driven by the intermediate transfer belt 108.

By the way, if the surface speed of the photosensitive drums 100 and that of the intermediate transfer belt 108 are equal to each other, a static friction coefficient becomes dominant in the drive-driven relationship therebetween. The friction torque being generated acts to prevent a surface speed difference from being caused between the photosensitive drum 100 and the intermediate transfer belt 108, and the magnitude of the friction torque incessantly varies. The maximum value of incessantly varying friction torque acting to prevent a surface speed difference from being caused is the maximum static friction torque. The maximum static friction torque is explained using the following expressions (1) to (3):

$$|T_F| \leq J \times d\omega/dt + T_L \quad (1)$$

$$|T_F| \leq J \times d\omega/dt + T_L - T_{AS} \quad (2)$$

$$|T_F| \leq J \times d\omega/dt + \Delta T_L \quad (3)$$

In the above expressions, symbols and their meanings are as follows: $T_F$ represents the friction torque, J the drum inertia, dω/dt angular acceleration of the photosensitive drum, $T_L$ the load torque, $T_{AS}$ represents the assist torque, and $\Delta T_L$ the varying torque component.

The expression (1) indicates that if the friction torque ($T_F$) is larger than the sum of the acceleration torque (J×dω/dt) represented by the first term on the right side and the load torque ($T_L$) represented by the second term on the right side, friction driving of the photosensitive drum 100 is possible. However, in actual, $T_F$ is far smaller than $T_L$, and hence friction driving of the photosensitive drums 100 is not possible.

The expression (2) is an expression of motion which represents a case where the BLDC motor 30 generates the assist torque ($T_{AS}$) that offsets the constant component of the load torque ($T_L$). When the assist torque ($T_{AS}$) is added to the load torque ($T_L$), the varying torque component ($\Delta T_L$) is left, and hence the expression (3) is obtained.

From the above, it is understood that friction driving of the photosensitive drum 100 is possible when the friction torque ($T_F$) is larger than the sum of the acceleration torque (J×dω/dt) and the varying torque component ($\Delta T_L$) represented respectively by the first term and the second term on the right side of the equation (3). Basically, the varying torque component ($\Delta T_L$) can be regarded as a negligibly small one. Therefore, to increase the friction driving capability by torque other than the assist torque ($T_{AS}$), it is envisaged from the equation (3) to increase the friction torque ($T_F$) or reduce the acceleration torque (J×dω/dt).

To change the friction torque ($T_F$) is not easy and simple for a designer because the friction torque ($T_F$) is closely related to the toner transfer process in the primary transfer. However, reduction of the acceleration torque (J×dω/dt) can be relatively easily achieved by reducing the drum inertia J.

The drum inertia J expresses all rotating loads as an inertia component of the drum shaft 50. An inertia component of the BLDC motor 30 appearing on the drum shaft 50 is largely influenced by a gear ratio between the reduction gear 51 and the motor shaft gear 32, and is represented by a value obtained by multiplying the motor shaft inertia by the square of the gear ratio. Therefore, inertia of a rotor of the BLDC motor 30 sometimes becomes much larger than the inertia component of the photosensitive drum 100 acting on the drum shaft 50.

To cope with this, the BLDC motor 30 in the present embodiment employs a low-inertia BLDC motor of an inner-rotor type.

As described above, the BLDC motor 30 offsets the constant component of the load torque on the drum shaft 50 by applying the assist torque, and also, a low-inertia motor is selected as the BLDC motor 30. This makes it positively possible to cause the intermediate transfer belt 108 to drive the photosensitive drum 100 by friction torque. Although in the present embodiment, the BLDC motor 30 is used as a generation source of the assist torque, this is not limitative, but any other component may be employed insofar as it generates a constant torque.

The outline of the friction torque and the friction driving of the photosensitive drums 100 has been described using the expressions of motion. However, the method of determining the assist torque by using the expressions (1) to (3) is not necessarily the best. The assist torque is equivalent to the load torque, and a person in charge of manufacture or a person in charge of design can measure the load torque. However, the measurement of the load torque is performed in a state different from a state of an actual print operation, and hence measurement errors arise.

The load torque is a torque generated by the BLDC motor 30 in a state in which the controller 20 causes the BLDC motor 30 to drive the photosensitive drum 100 such that the surface speed of the photosensitive drum 100 becomes equal to that of the intermediate transfer belt 108. Although in the actual print operation, the photosensitive drum 100 and the intermediate transfer belt 108 are in contact with each other, unless the load toque is measured in a state in which the both are separated from each other, it is impossible to distinguish the load torque from the friction torque. Therefore, the measurement is required to be performed in the state in which the photosensitive drum 100 and the intermediate transfer belt 108 are separated from each other.

If there is a constant difference in surface speed between the photosensitive drum 100 and the intermediate transfer belt 108, the friction torque is constantly generated between the photosensitive drum 100 and the intermediate transfer belt 108 during the print operation. In this case, the drive-driven relationship tends to be disturbed depending on the magnitude of the difference in surface speed. Detailed description will be given hereinafter.

Next, a method of realizing the stable friction driving control will be described.

The assist torque for realizing the stable friction driving control without any slip is sometimes referred to as the "optimum assist torque". The optimum assist torque is a value of the assist torque which holds the friction between the photosensitive drum 100 and the intermediate transfer belt 108 in a static friction state whatever torque variation 581 (see FIG. 8) may be applied to the drum shaft 50 causing rotation of the photosensitive drum 100.

The torque variation 581 can cause the static friction torque to act on the photosensitive drums 100 in a direction of normal rotation and a direction of reverse rotation. When the torque variation 581 is within a range of the static friction torque defined by positive and negative values of the maximum static friction torque associated with respective directions of normal and reverse rotation of the photosensitive drum 100, the static friction state is maintained. The range defined by the positive and negative values of the maximum static friction torque is hereinafter referred to as the "friction driving region". The optimum assist torque is a value of assist torque within a range corresponding to the friction driving region of the static friction torque, and as described hereinafter, the controller 20 gives such a torque command value as will realize the optimum assist torque to the motor driver IC 24 to thereby cause the BLDC motor 30 to operate.

Figure 9:
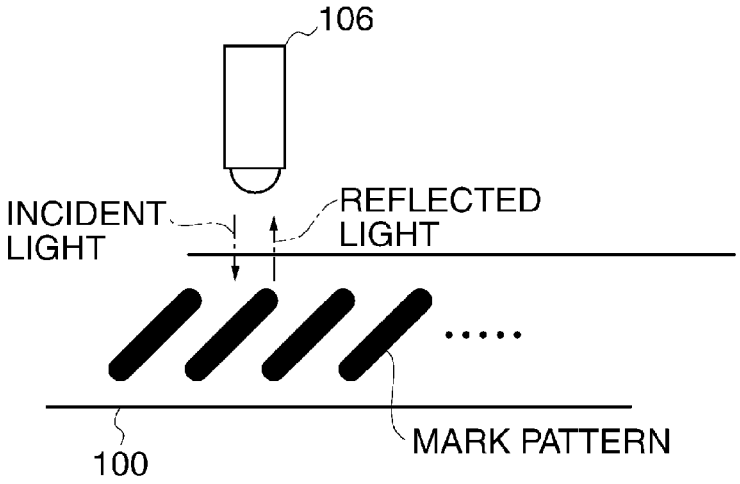
FIG. 9 is an enlarged diagram useful in explaining a relationship between a pair of a photosensitive drum and a surface position-detecting section.

FIG. 9 is an enlarged diagram useful in explaining a relationship between a pair of the photosensitive drum 100 and the surface position-detecting section 106.

Detection of the surface position on the photosensitive drum 100 is realized by using a reflective photoelectric sensor for the surface position-detecting section 106. As shown in FIG. 9, a mark pattern is drawn on the surface of the photosensitive drum 100 at equally-spaced intervals in advance. Note that the mark pattern is not drawn in an image forming area on the photosensitive drum 100. The reflective photoelectric sensor is based on the principle of operation in which a mark pattern is detected by detecting reflection of incident light on the mark pattern, and hence sensor output is changed between each portion having a mark and each portion having no mark.

Further, by setting a proper threshold value to the voltage, the output waveform becomes rectangular. To identify a position on the surface of the photosensitive drum 100, a reference position is set in advance. Then, by counting the number of rectangular waves detected from the reference position, the surface position on the photosensitive drum 100 can be uniquely detected with accuracy dependent on a resolution of the mark pattern.

In FIG. 4 referred to hereinabove, a surface position on the photosensitive drum 100 at a certain time is detected by the surface position-detecting section 106, and a detection signal indicative of detection of the surface position is input to the ASIC 60 of the sub-scanning synchronized exposure section D. The ASIC 60 controls timing of outputting an exposure signal for drawing a print image. More specifically, the ASIC 60 controls exposure in accordance with a surface position on the photosensitive drum 100 based on the detection signal indicative of detection of the surface position (i.e. in synchronism with detection of the surface position). This makes it possible to draw an electrostatic latent image on the photosensitive drum 100 without positional displacement, using the laser driver 61 and the exposure device 101K. As a result of the developing process executed thereafter, the toner image without positional displacement, which is synchronized with detection of the surface position, is formed on the photosensitive drum 100 (forming unit). The plurality of toner images formed on the respective photosensitive drums 100 are superimposed on the intermediate transfer belt 108 to form a color image. The color image is transferred onto the recording sheet P, and is fixed on the recording sheet P by the fixing device 114 disposed at the location downstream of the secondary transfer section.

Figure 10:
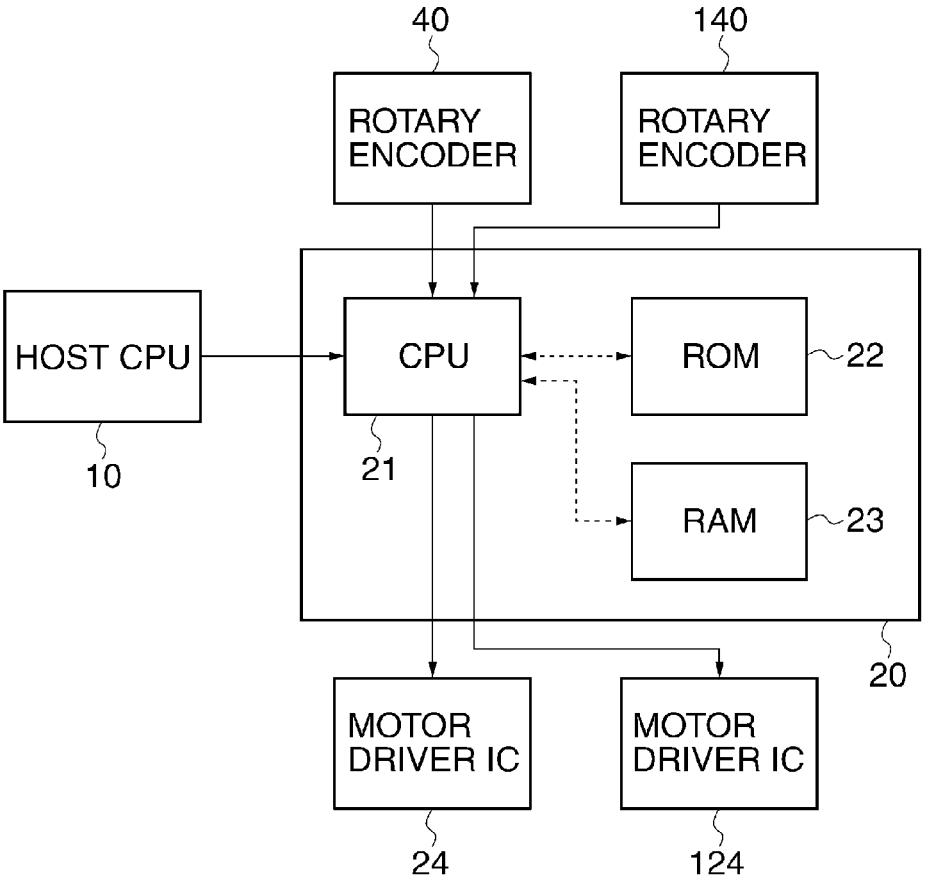
FIG. 10 is a block diagram showing the internal configuration of a controller, and associated elements.

FIG. 10 is a block diagram of the internal configuration of the controller 20 shown in FIGS. 2 and 3 and elements associated therewith. Referring to FIG. 10, the controller 20 mainly comprises a CPU 21, a ROM 22, and a RAM 23. The CPU 21 calculates a speed based on a speed detection signal output from the rotary encoder 40 (40, 140). Further, the controller 20 performs general control operations for proportional control, derivative control, and integral control, described in a program stored in the ROM 22, based on comparison between the calculated speed and a target process speed, and thereby performs speed feedback control for each associated one of the photosensitive drums 100 and the intermediate transfer belt 108.

In the above-described image forming apparatus 200, the controller 20 causes photosensitive drums 100Y to 100K to be friction-driven by the intermediate transfer belt 108, and controls the photosensitive drums 100Y to 100K and the intermediate transfer belt 108 such that the surface speed of each of the photosensitive drums 100Y to 100K is always equal to the surface speed of the intermediate transfer belt 108.

Next, a method of determining the optimum assist torque will be described.

Figure 11A:
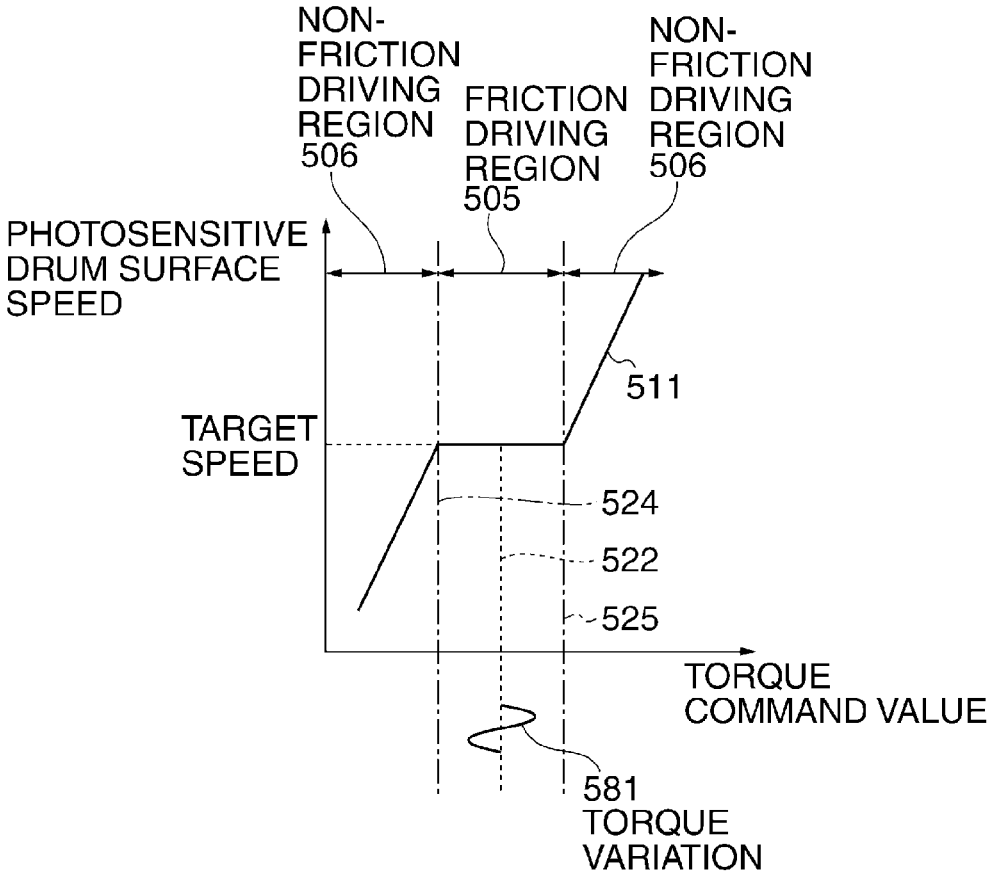
FIGS. 11A to 11C are diagrams showing a relationship between a torque command value set for rotating the photosensitive drum and a surface speed of the photosensitive drum, during printing.
Figure 11B:
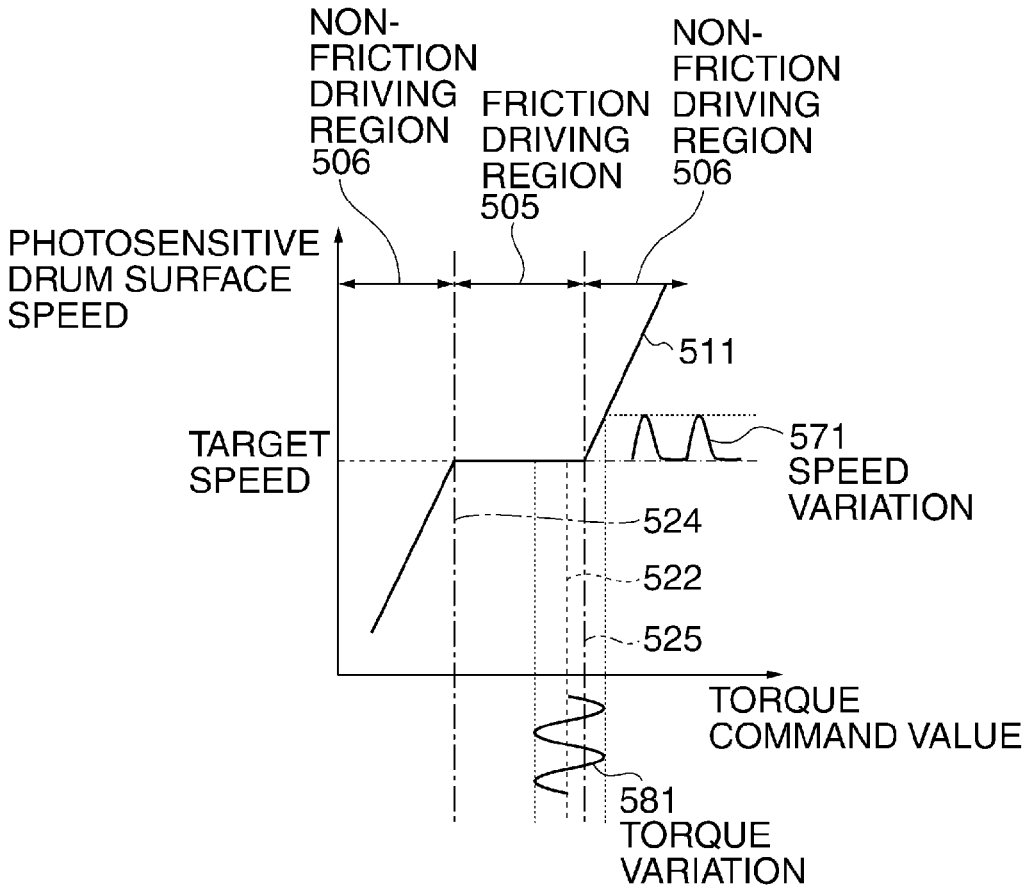
Figure 11C:
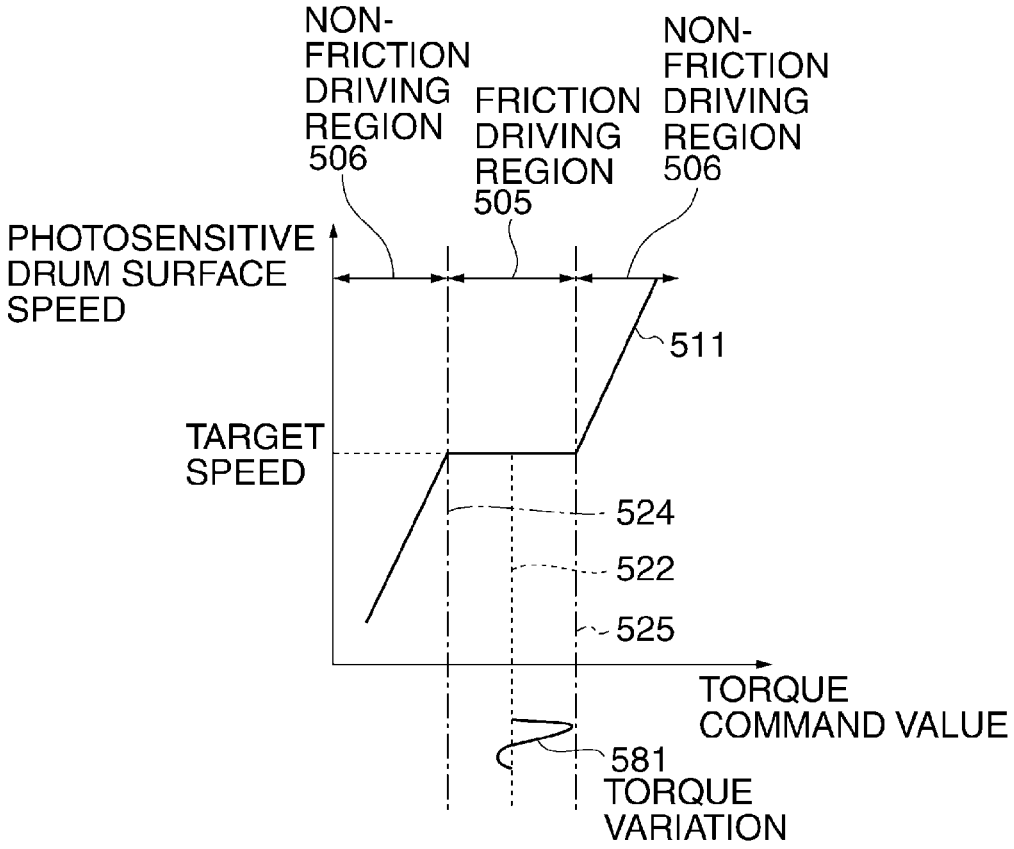

FIGS. 11A to 11C are diagrams each showing a relationship between a torque command value output to rotate a photosensitive drum 100 and the surface speed of the photosensitive drum 100 during printing. FIGS. 11A to 11C each indicate a surface speed 511 of the photosensitive drum 100, which is detected when torque generated by the BLDC motor 30 is increased and reduced, in a state of the intermediate transfer belt 108 rotating at a constant surface speed (target speed) during printing.

Since it is during printing, the photosensitive drums 100 and the intermediate transfer belt 108 are in contact with each other. A torque command value given from the controller 20 to each photosensitive drum 100 (to each motor driver IC 24, to be exact) becomes a value of torque generated by the BLDC motor 30. The surface speed 511 is grasped based on the detection result from the rotary encoder 40. More specifically, the surface speed 511 is acquired by plotting an average value of a plurality of detection results with respect to the same torque command value.

If it is assumed that the photosensitive drum 100 alone is rotated, an increase in the torque command value given to the photosensitive drum 100 increases the surface speed 511 as a matter of course. However, the photosensitive drum 100 is in contact with the intermediate transfer belt 108, and hence there is a region having no change in the surface speed 511 even though the torque command value is increased. This region is the friction driving region, denoted by reference numeral 505, which corresponds to the range defined by the positive and negative values of the maximum static friction torque, and in which the surface of the photosensitive drum 100 is in the static friction state.

A minimum torque command value 524 and a maximum torque command value 525, corresponding to end positions of the friction driving region 505, correspond to the above-mentioned negative and positive values defining the range of the maximum static friction torque. Further, a torque command value 522 corresponds to a point at which the range of the maximum static friction torque is divided into positive and negative ranges, where the friction torque is ±0. That is, as the torque command value is shifted closer to the torque command value 524 or 525 from the center as the point where the friction torque is ±0, the magnitude of the friction torque becomes larger (although the direction of the friction torque differs).

When the torque command value exceeds the range corresponding to the friction driving region 505, the region has changed to a non-friction driving region 506, where a dynamic friction coefficient becomes dominant in the drive-driven relationship therebetween, and the magnitude of the friction torque suddenly drops from the magnitude of the maximum static friction torque. The torque command values 524 and 525 are the values of torque generated by the BLDC motor 30 at respective time points when the surface speed 511 of the photosensitive drums 100 starts to change when the torque command value is reduced and increased. A point of change in the surface speed 511 in the decreasing direction corresponds to the torque command value 524, and a point of change in the same in the increasing direction corresponds to the torque command value 525.

A median value between these two torque command values 524 and 525 corresponds to the torque command value 522. As exemplified in FIG. 11A, when the average value of the torque variation 581 is equal to 0 (the center of waves coincides with the median value between the torque command values 524 and 525), the torque command value 522 may be regarded as the optimum assist torque. However, as exemplified in FIG. 11C, there is a case where the average value of the torque variation 581 is not equal to 0, and hence the optimum assist torque is not always the median value.

If the value of the assist torque is not properly determined, the relationship between the torque command value and the surface speed becomes as shown in FIG. 11B. For example, there is a case corresponding to this, which can be caused as a consequence of deriving the assist torque using the above-described expressions. The median value 522 of the derived assist torque is within the range corresponding to the friction driving region 505, but is close to a value corresponding to the end position (torque command value 525) of the friction driving region 505. Further, the torque variation 581 sometimes becomes larger than a predicted range due to influence of high transfer pressure applied for the primary transfer, which cannot be grasped in the measurement of the assist torque performed in the state where the photosensitive drums 100 and the intermediate transfer belt 108 are made separate from each other.

In such a case, the torque variation 581 sometimes goes out of the friction driving region 505 as exemplified in FIG. 11B. When the torque variation 581 goes out of the friction driving region 505, this is reflected on the surface speed 511 of the photosensitive drums 100 as a speed variation 571. That is, the surface speed of the photosensitive drums 100 and that of the intermediate transfer belt 108 cease to match. This causes color shift or banding.

Next, a real machine operation will be described. In general, when the main power is turned on, first, a multifunction peripheral enters an adjustment mode. In the present embodiment, the ASIC 60 adjusts the temperature of the fixing rollers of the fixing device 114, corrects inclination of main scanning lines, corrects displacement between colors, and so forth, in the adjustment mode. Only after completion of the adjustment mode, the user becomes capable of instructing a print operation. In the present embodiment, the controller 20 provides a sequence for deriving the assist torque in the adjustment mode. As described above, the assist torque is torque generated by the BLDC motor 30 so as to offset the constant component of the load torque.

In general, the multifunction peripheral is capable of performing processing at a plurality of process speeds e.g. so as to cope with thick paper, and also in the image forming apparatus according to the present embodiment, a plurality of process speeds can be set. Therefore, the assist torque is required to be derived on a process speed-by-process speed basis.

The assist torque is derived by executing the image formation process by the image forming apparatus similarly to the print operation, and measuring the surface speed of the photosensitive drums 100 by the controller 20. In the present embodiment, the surface speed is acquired based on the detection result from the rotary encoder 40. Note that the surface speed may be grasped by using the detection result from the surface position-detecting section 106 in place of that from the rotary encoder 40. The speed detection unit for detecting the surface speed is not particularly limited, but any other suitable device may be employed insofar as it can detect the speed of the photosensitive drum 100, and a detection result from a sensor that directly or indirectly detects the surface speed of each photosensitive drum 100 may be used.

The controller 20 causes electric current to flow through the BLDC motor 30 so as to rotate the photosensitive drum 100. As the motor driver IC 24, there is used a driver IC that determines based on the PWM signal a phase current caused to flow through the BLDC motor 301. As described hereinabove, the magnitude of the torque to be generated by the BLDC motor 30 is determined by the duty ratio of the PWM signal. In adjusting the assist torque to be generated during the image formation process, the controller 20 has to adjust the duty ratio such that the surface speed of the photosensitive drums 100 becomes equal to the target process speed.

To this end, before shipment of the product (the image forming apparatus 200), an optimum assist torque is derived and a duty ratio corresponding to the value of the assist torque is written beforehand in the ROM 22 (see FIG. 10) as a storage unit. When the image forming apparatus 200 operates initially after the shipment, the CPU 21 reads the duty ratio from the ROM 22, inputs the read duty ratio to the motor driver IC 24 as the duty ratio of the PWM signal, and causes the BLDC motor 30 to output a constant assist torque.

After the shipment, when the optimum assist torque has been newly derived according to the sequence for deriving the assist torque, the CPU 21 writes the duty ratio corresponding to the derived assist torque in the RAM 23. In a case where the sequence for deriving the assist torque has been executed twice or more after the shipment, the duty ratio corresponding to the latest assist torque is written in the RAM 23, whereby the duty ratio is updated. In the case where the duty ratio has been written in the RAM 23, the CPU 21 reads the duty ratio not from the ROM 22, but from the RAM 23. Normally, during the print operation, the duty ratio is not updated but the duty ratio used is a fixed value.

Next, an example of a process for deriving assist torque will be described with reference to flowcharts in FIGS. 12, 13, and 15.

Figure 12:
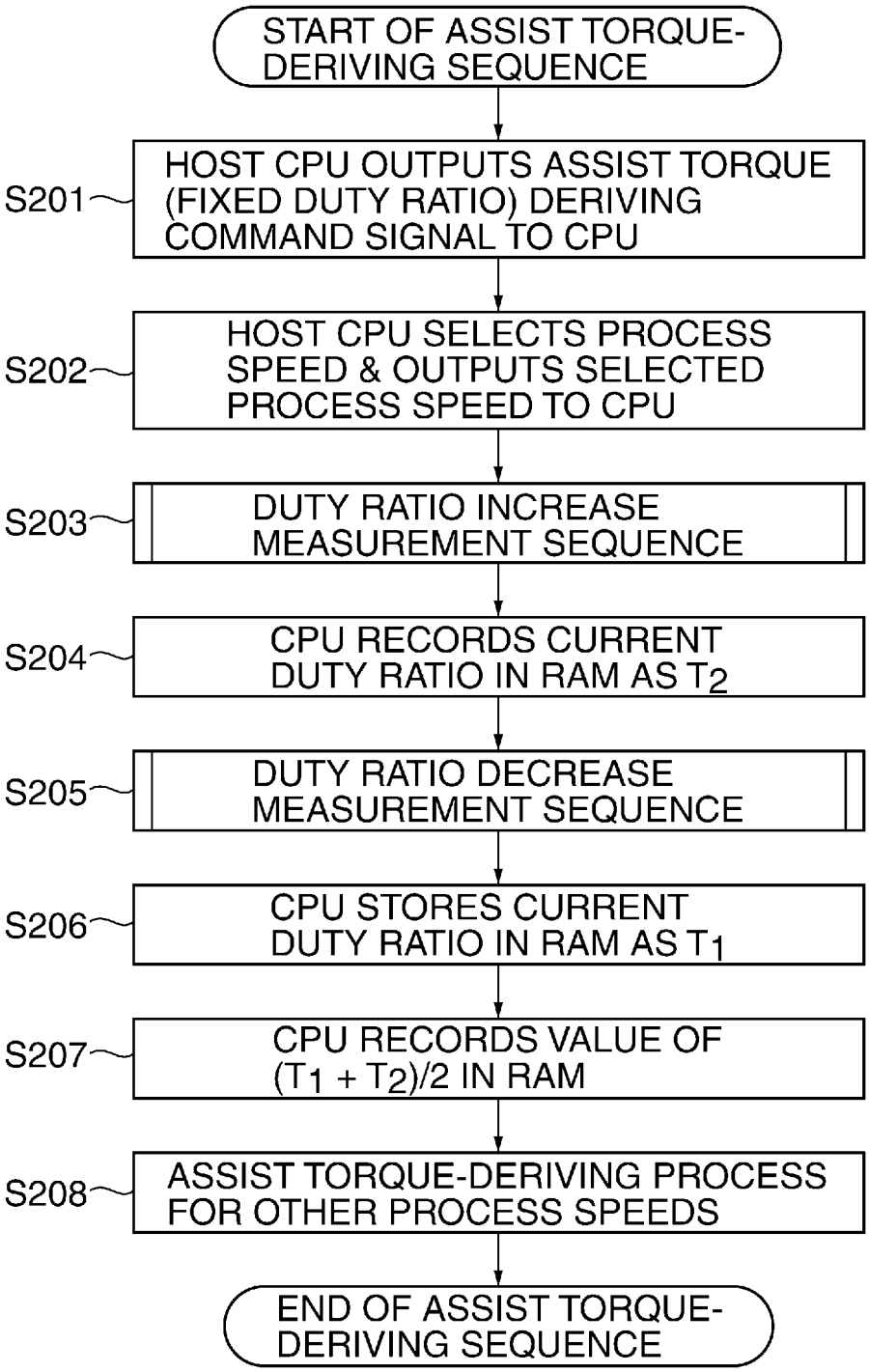
FIG. 12 is a flowchart of an assist torque-deriving process.

FIG. 12 is a flowchart of the assist torque-deriving process.

The assist torque is derived on a process speed-by-process speed basis and for each photosensitive drum 100. First, in a step S201, the host CPU 10 outputs a derive command signal to the CPU 21 for instructing the start of derivation of a duty ratio which corresponds to the assist torque. In the step S201, the host CPU 10 selects a process speed for performing a print operation according to e.g. the type of a recording sheet, and outputs information on the selected process speed to the CPU 21 (step S202). The CPU 21 sets the received process speed as the current process speed.

In a step S203, a duty ratio increase measurement sequence in FIG. 13, described hereinafter, is executed. That is, the CPU 21 measures an average value of the surface speed of the photosensitive drum 100 and a duty ratio corresponding to a value of torque generated by the BLDC motor 30 when the duty ratio (i.e. the torque command value) is increased from the friction driving region until a non-friction driving region is reached.

Figure 13:
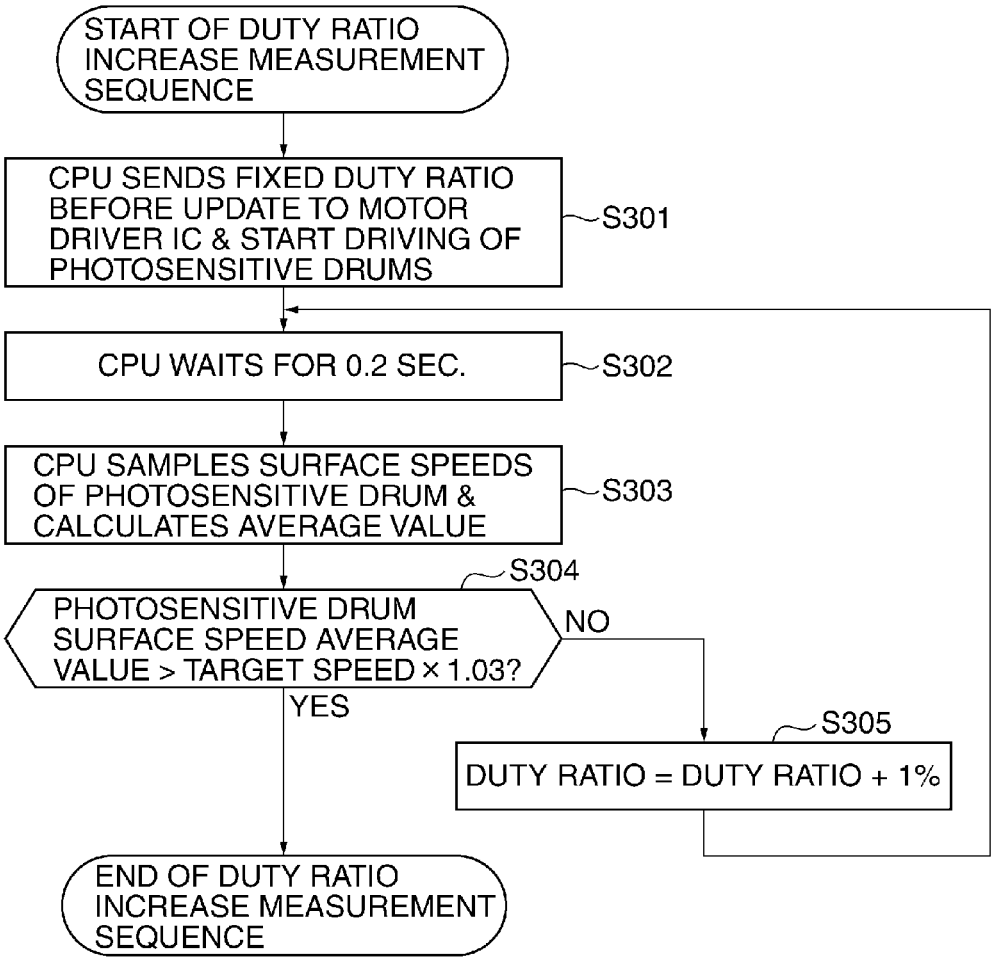
FIG. 13 is a flowchart of a duty ratio increase measurement sequence.
Figure 14A:
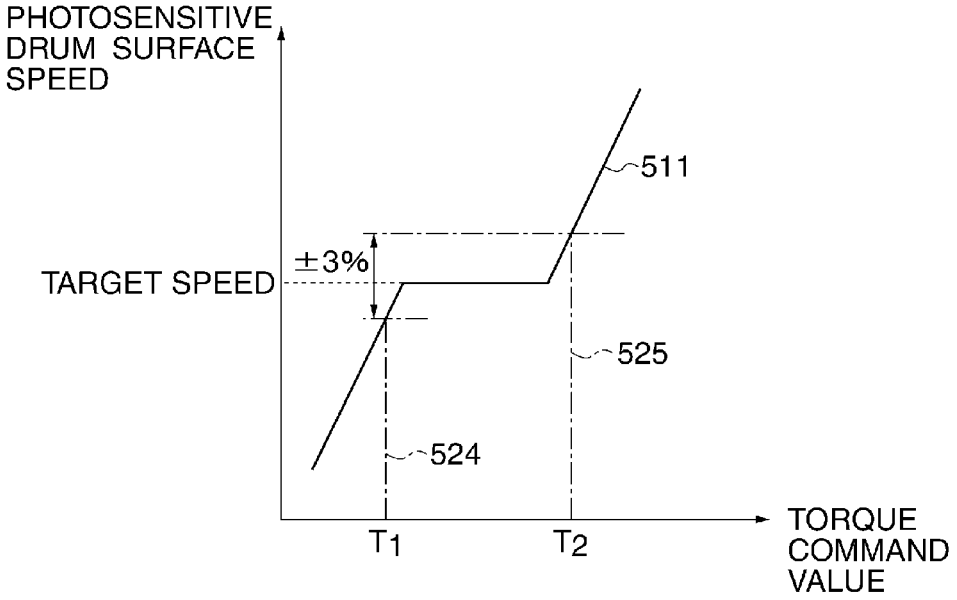
FIGS. 14A and 14B are diagrams showing a relationship between the torque command value and the surface speed of the photosensitive drum in the duty ratio increase measurement sequence and a duty ratio decrease measurement sequence.
Figure 14B:
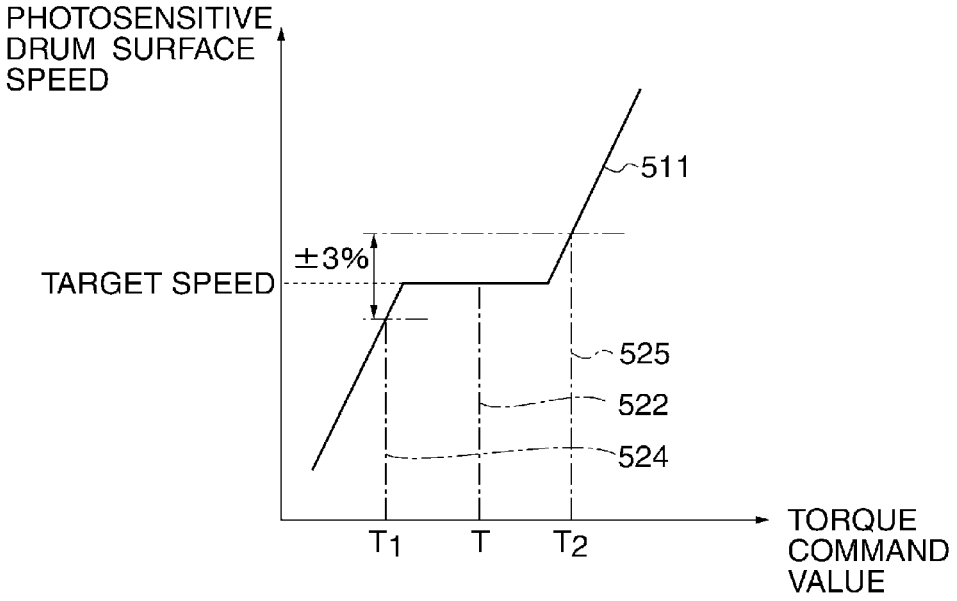

FIGS. 14A and 14B are diagrams each showing a relationship between the torque command value and the surface speed of the photosensitive drum 100 in the duty ratio increase measurement sequence and a duty ration decrease measurement sequence. FIG. 13 is a flowchart of the duty ratio increase measurement sequence executed in the step S203 in FIG. 12. In the sequencing process in FIG. 13, the CPU 21 derives the duty ratio $T_2$ corresponding to the positive value of the maximum static friction torque (torque command value 525) shown in FIG. 14A.

First, in a step S301 in FIG. 13, the CPU 21 inputs the duty ratio before correction to the motor driver IC 24, and drives the BLDC motor 30 to rotate the photosensitive drum 100. Note that the duty ratio before correction mentioned here is a value read from the RAM 23 in a case where the CPU 21 has already written an updated value of the duty ratio in the RAM 23, and is a value read from the ROM 22 in a case where the CPU 21 has not written any updated value of the duty ratio in the RAM 23 yet.

In the step S301, further, the CPU 21 performs the feedback control for the surface speed of the intermediate transfer belt 108 in parallel with driving of the photosensitive drum 100 for rotation. That is, the CPU 21 controls the BLDC motor 130 such that the surface speed of the intermediate transfer belt 108 becomes equal to the target speed (currently set process speed). At this time, the intermediate transfer belt 108 and the photosensitive drum 100 are in contact with each other, and the CPU 21 continues the speed control for the intermediate transfer belt 108 during a time period for deriving the assist torque.

In a step S302, after the duty ratio is changed, the CPU 21 waits for a predetermined time period (e.g. 0.2 seconds) until the surface speed of the photosensitive drums 100 is stabilized. Then, in a step S303, the CPU 21 samples a plurality of (e.g. 10) values of the surface speed of the photosensitive drum 100 grasped by the detection result from the surface position-detecting section 106, at predetermined time intervals (e.g. every 10 msec.), and calculates an average value of the sampled values of the surface speed.

In a step S304, the CPU 21 determines whether or not the average value of the surface speed of the photosensitive drum 100 is larger than an upper limit value (+3%) of a predetermined range (e.g. ±3%) of the target speed. That is, the CPU 21 determines whether or not the average value of the surface speed>the target speed×1.03 is satisfied. The target speed of the surface speed of the intermediate transfer belt 108 as a reference for comparison used in this step may be set to an average value of actual values of the surface speed of the intermediate transfer belt 108 grasped from the detection result from the rotary encoder 140.

The above-mentioned predetermined range of the speed (±3%) is a range set by taking an allowance into account, and if the condition in the step S304 is not satisfied, it can be judged that the static friction state between the photosensitive drums 100 and the intermediate transfer belt 108 is maintained. Therefore, the CPU 21 sets a value obtained by adding a predetermined amount (e.g. an amount corresponding to 1%) to the current duty ratio as a new duty ratio in a step S305. Then, the CPU 21 inputs the new duty ratio to the motor driver IC 24 to thereby increase the assist torque.

Thereafter, the CPU 21 returns to the step S302, and repeats the same procedure as described above until the condition in the step S304 is satisfied.

If the condition in the step S304 is satisfied, it can be judged that the friction state between the photosensitive drums 100 and the intermediate transfer belt 108 has changed to the dynamic friction state (non-driving region has been reached). Therefore, the CPU 21 exits from the process in FIG. 13, and proceeds to a step S204 in FIG. 12. In the step S204, the CPU 21 stores the current duty ratio in the RAM 23 as the duty ratio $T_2$ corresponding to the positive value of the maximum static friction torque (torque command value 525).

Next, in a step S205, the CPU 21 executes the duty ratio decrease measurement sequence in FIG. 15, described hereinafter. That is, the CPU 21 measures an average value of the surface speed of the photosensitive drum 100 and a duty ratio corresponding to a value of torque generated by the BLDC motor 30 when the duty ratio is decreased from the friction driving region until the non-friction driving region is reached.

Figure 15:
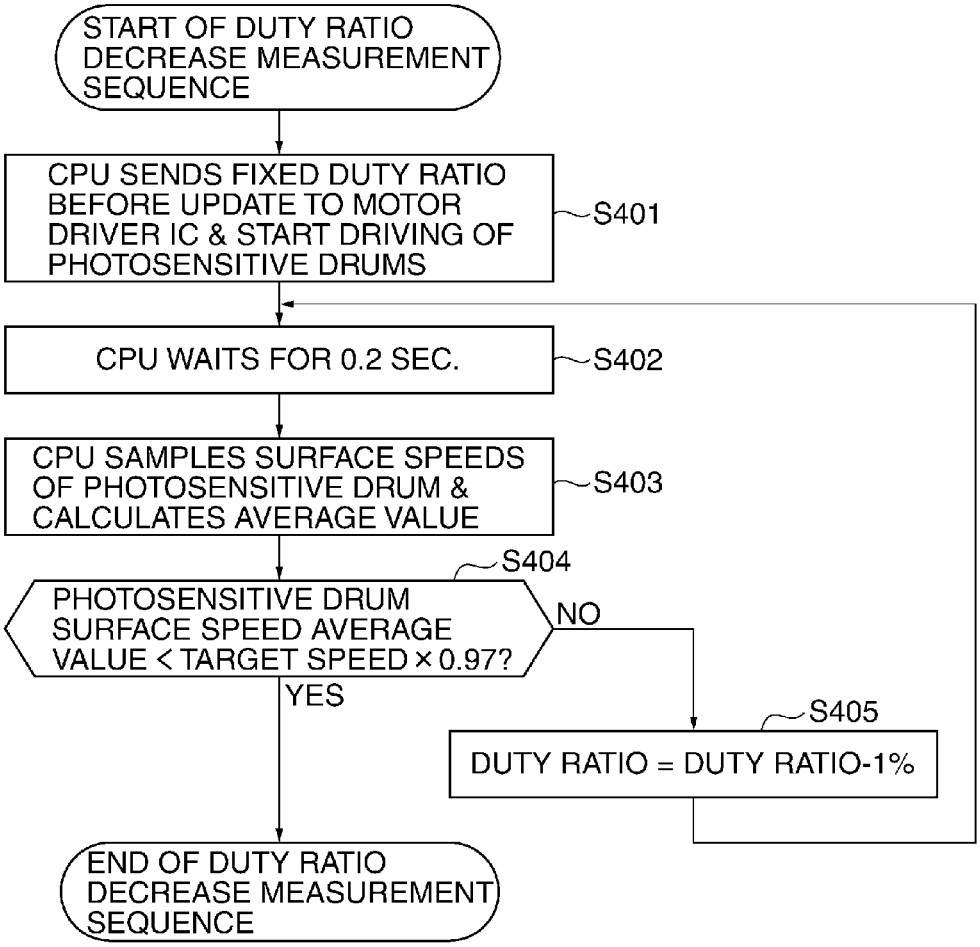
FIG. 15 is a flowchart of the duty ratio decrease measurement sequence.

FIG. 15 is a flowchart of the duty ratio decrease measurement sequence. In the sequencing process in FIG. 15, the CPU 21 derives the duty ratio $T_1$ corresponding to the negative value of the maximum static friction torque (torque command value 524) as shown in FIG. 14A.

Steps S401 to S403 in FIG. 15 are the same as the steps S301 to S303 in FIG. 13. In a step S404, the CPU 21 determines whether or not the average value of the surface speed of the photosensitive drums 100 is smaller than a lower limit value (−3%) of the above-mentioned predetermined range of the target speed. That is, the CUP 21 determines whether or not the average value of the surface speed<the target speed× 0.97 is satisfied.

If the condition in the step S404 is satisfied, it can be judged that the static friction state between the photosensitive drums 100 and the intermediate transfer belt 108 is maintained. Therefore, the CPU 21 sets a value obtained by subtracting a predetermined amount (e.g. an amount corresponding to 1%) from the current duty ratio as a new duty ratio in a step S405. Then, the CPU 21 inputs the new duty ratio to the motor driver IC 24 to thereby reduce the assist torque.

Thereafter, the CPU 21 returns to a step S402, and repeats the same procedure until the condition in the step S404 is satisfied. If the condition in the step S404 is satisfied, it can be judged that the friction state between the photosensitive drums 100 and the intermediate transfer belt 108 has changed to the dynamic friction state. Therefore, the CPU 21 exits from the process in FIG. 15, and proceeds to a step S206 in FIG. 12. In the step S206, the CPU 21 records the current duty ratio in the RAM 23 as the duty ratio $T_1$ corresponding to the negative value of the maximum static friction torque (torque command value 524).

Therefore, in the steps S204 and S206, the torque values generated by the BLDC motor 30 at two time points where the surface speed of the photosensitive drums 100 deviates from the target speed of the constant surface speed by an amount larger than the predetermined amount are recorded as the duty ratios $T_2$ and $T_1$.

Next, in a step S207, the CPU 21 writes the median value T between the duty ratios $T_1$ and $T_2$, expressed by $T=(T_1+T_2)/2$, in the RAM 23 as the newly set duty ratio (decision unit).

Next, in a step S208, the host CPU 10 and the CPU 21 execute the steps S201 to S207 with respect to other process speeds to derive a duty ratio associated with each process speed. Thus, the sequence for deriving the assist torque is performed.

As described above, in the duty ratio increase measurement sequence and duty ratio decrease measurement sequence, the torque generated by the BLDC motor 30 is gradually increased and decreased. Then, the duty ratios $T_1$ and $T_2$ corresponding to two values of the torques generated by the BLDC motor 30 when the surface speed of the photosensitive drum 100 has changed in the decreasing direction and the increase direction, respectively, are recorded. Then, the duty ratio of the median value T is recorded based on the duty ratios $T_1$ and $T_2$ as the optimum assist torque.

As described hereinafter with reference to FIG. 16, in a printing-time process, the duty ratio corresponding to the assist torque determined by the CPU 21 is input to the motor driver IC 24 to thereby drive the photosensitive drum 10 for rotation. As described above, the optimum assist torque is different also depending on the average value of torque variation in image formation, and is not necessarily equal to the median value T. When the pattern or the like of the torque variation 581 is known, not the median value T but a value closer to the duty ratio $T_1$ or $T_2$ may be set as the optimum assist torque using a weight coefficient $\alpha$ larger than 0.

For example, the CPU 21 may multiply one of the duty ratios by the weight coefficient $\alpha$, to thereby record a value of $(\alpha T_1+T_2)/2$ or $(T_1+\alpha T_2)/2$ in the RAM 23 as the new duty ratio. In any case, the CPU 21 decides the optimum assist torque within a range between the determined two torque values (duty ratio $T_1$ and duty ratio $T_2$).

Note that in setting the optimum assist torque, it is preferable to take into account the setting of transfer pressure applied for the primary transfer, if possible, to thereby set the duty ratio which makes it possible to cause the photosensitive drum 100 to be properly friction-driven by the intermediate transfer belt 108 without any slip even when the torque variation 581 occurs on the photosensitive drum 100 during image formation.

Next, the actual print operation will be described. FIG. 16 is a flowchart of a printing-time process. The printing-time process is started when a print operation command is input from a user interface (UI) or a personal computer.

When the print operation command is input to the host CPU 10, the host CPU 10 starts to perform control of the respective devices of the image forming apparatus for printing. First, when the controller 20 receives a control command from the host CPU 10, a step S601 is executed. In the step S601, the CPU 21 outputs drive command signals for instructing driving of the photosensitive drums 100 and the intermediate transfer belt 108 based on information of the process speed input from the host CPU 10 to the CPU 21 of the controller 20. The drive command signals used in this step are a process speed signal, a drive-on signal, etc.

Next, in a step S602, the CPU 21 sets a value of the duty ratio associated with the currently set process speed for each photosensitive drum 100 as the assist torque to be initially set. The duty ratio set in this step is a value recorded in the RAM 23 in a case where the CPU 21 has already written an updated value of the duty ratio in the RAM 23, or a value recorded in the ROM 22 in a case where the CPU 21 has not written the updated value of the duty ratio in the RAM 23 yet.

In a step S603, the CPU 21 outputs the drive-on signal and the PWM signal of the currently set duty ratio to each motor driver IC 24, and starts to drive each associated photosensitive drum 100. In parallel with this, to drive the intermediate transfer belt 108, the CPU 21 outputs various control signals to the motor driver IC 124, and starts the speed feedback control for controlling the surface speed to a constant speed based on a signal output from the rotary encoder 140.

By execution of the step S603, the intermediate transfer belt 108 is controlled to rotate at the constant surface speed, and the photosensitive drums 100 are controlled at the respective constant duty ratios. Assist torque applied according to each constant duty ratio offsets a constant component of load torque on the associated photosensitive drum 100 during rotation thereof. Therefore, it is unnecessary to increase the transfer pressure applied for the primary transfer to increase the friction torque in causing the photosensitive drums 100 to be friction-driven by the intermediate transfer belt 108.

Next, in a step S604, the CPU 21 determines whether or not a stop signal is input from the host CPU 10. The CPU 21 continues the determination until the stop signal is input from the host CPU 10, and when the stop signal is input, the CPU 21 sends a drive stop signal to the motor driver ICs 24 and 124 to thereby stop driving of the photosensitive drums 100 and the intermediate transfer belt 108 in a step S605.

According to the present embodiment, first, toner images are formed on the photosensitive drums 100 by the sub-scanning synchronized exposure each in synchronism with detection of a surface position on the associated photosensitive drum 100. Then, during the image formation period (at least during primary transfer of each toner image), the CPU 21 controls the intermediate transfer belt 108 to rotate at the constant surface speed, and controls the photosensitive drum 100 to be friction-driven by the intermediate transfer belt 108 using the frictional force generated between the photosensitive drum 100 and the intermediate transfer belt 108. In doing this, the CPU 21 causes the BLDC motor 30 to apply the assist torque to the photosensitive drum 100 so as to set the friction state between the photosensitive drum 100 and the intermediate transfer belt 108 to the static friction state. This makes it possible to rotate each photosensitive drum 100 and the intermediate transfer belt 108 at the same surface speed without increasing the transfer pressure applied for the primary transfer, and makes it possible to prevent positional displacement between transferred toner images. This, in turn, prevents color shift and banding, and thereby contributes to improvement of image quality.

Next, a description will be given of a second embodiment of the present invention. The second embodiment is distinguished from the first embodiment in the method of deriving the assist torque and the assist torque-deriving process in a friction drive system, described hereinafter, and is the same in the other hardware configuration and software configuration. Component elements corresponding to those in the first embodiment are denoted by the same reference numerals, and description thereof is omitted.

First, the method of deriving the assist torque in the friction drive system in the present embodiment will be described. As described in the first embodiment, the load torque on each photosensitive drum 100 varies according to a plurality of process speeds including a process speed adapted to the use of thick paper in the image forming apparatus. Therefore, it is preferable to derive the assist torque for offsetting the load torque according to each process speed in advance.

In general, when the main power to the image forming apparatus is turned on, first, the image forming apparatus enters a state called the adjustment mode. In the adjustment mode, adjustment of temperature of the fixing rollers of the fixing device, correction of inclination of the main scanning lines, correction of displacement between colors, and so forth are performed. When the adjustment mode is terminated, the image forming apparatus shifts to a print mode in which a print operation can be performed.

In the present embodiment, a sequence for deriving the assist torque is provided in the adjustment mode. In the assist torque deriving sequence in the adjustment mode, the host CPU 10 causes the primary transfer rollers 107 to retract by controlling a driver IC (not shown) of a stepper motor for moving the primary transfer rollers 107 up and down. This is to eliminate the influence of friction in primary transfer sections. Further, the host CPU 10 controls the various devices which execute the image formation process, such as the exposure devices 101, the electrostatic charging rollers 105, and the developing devices 102, and provides an instruction for driving the photosensitive drums 100.

The assist torque is for offsetting the load torque, and is calculated from a value of torque generated by the BLDC motor 30. As the motor driver IC 24 (see FIG. 2) for controlling the BLDC motor 30, a driver IC is used which determines a phase current applied to the BLDC motor 30 based on the PWM signal. The PWM signal is a pulse width modulation signal which is a rectangular wave signal generated at a constant repetition period, and each phase current is adjusted based on a ratio of a high-level duration of the signal and one repetition period of the signal (duty ratio: a ratio obtained by dividing the high-level duration by the one repetition period of the signal). When the duty ratio is large, a large amount of electric current is applied to each phase, whereas when the duty ratio is small, a small amount of electric current is applied to the phase. The magnitude of the phase current is equivalent to torque generated in the motor, and is proportional to the duty ratio. Therefore, the duty ratio can be regarded as torque generated by the motor.

Before deriving the assist torque, first, the primary transfer rollers 107 are retracted from the intermediate transfer roller 108. Further, derivation of the assist torque is performed during the image formation process in which interferences by the electrostatic charging rollers 105, the developing devices 102, toner, and the blades of the cleaners 104 have influence on the load torque. Note that a varying torque component of load in the image formation process is sufficiently small compared with a constantly generated component of the load, and hence in deriving the assist torque, the image forming apparatus may be in an idling state.

Figure 17:
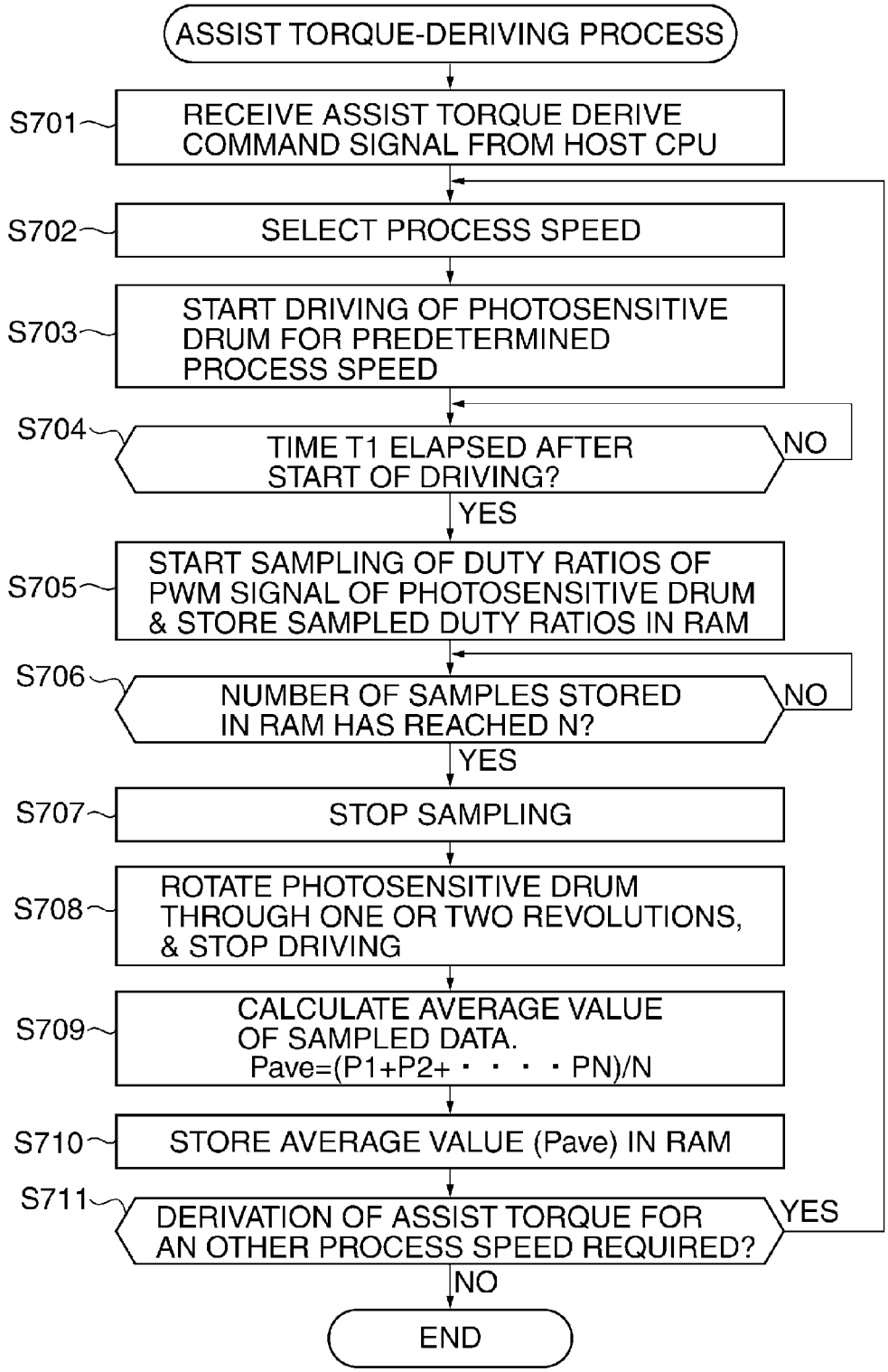
FIG. 17 is a flowchart of an assist torque-deriving process executed by an image forming apparatus according to a second embodiment of the present invention.

FIG. 17 is a flowchart of the assist torque-deriving process executed by the image forming apparatus according to the present embodiment. The assist torque-deriving process is executed by the CPU 21 which executes an assist torque derivation program in response to a command from the host CPU 10.

When the assist torque-deriving process is started, first, the CPU 21 receives a process speed set value, an assist derivation-on command, etc., as assist torque derive command signals from the host CPU 10 (step S701). Then, the CPU 21 selects a process speed for deriving assist torque according to e.g. a thickness of an associated recording sheet P (step S702).

After the process speed has been selected, the CPU 21 outputs a control signal to the motor driver IC 24 for performing the speed feedback control for controlling each photosensitive drum 100 at a predetermined process speed to thereby start driving of the photosensitive drum 100 (step S703).

The CPU 21 having started driving of each photosensitive drum 100 waits until a predetermined time (time T1) elapses after the start of driving of the photosensitive drum 100 (step S704). After the elapse of the predetermined time, the CPU 21 starts sampling of the duty ratio of the PWM signal for the photosensitive drum 100, and stores the sampled value in the RAM 23 (step S705). Here, a value sampled for an n-th time is expressed by $P_n$ (n=a natural number within a range of 1 to N).

Then, the CPU 21 continues sampling until the number of sampled values stored in the RAM 23 reaches a predetermined number (=N) (step S706), and after the number of sampled values reaches the predetermined number (=N), the CPU 21 stops sampling (step S707). After sampling has been terminated, the host CPU 10 stops the electrostatic charging rollers 105, the exposure devices 101, and the developing devices 102.

Then, the CPU 21 causes the photosensitive drums 100 to rotate through one or two revolutions, and stops driving of the photosensitive drums 100 by outputting a drive stop command (step S708). The photosensitive drums 100 are rotated through one or two revolutions so as to remove toner on the photosensitive drums 100 by the cleaners 104.

Next, the CPU 21 calculates an average value of the sampled duty ratios (P) by the following equation (4) (step S709):

$$P_{ave}=(P_1+P_2+P_3+\ldots+P_N)/N \tag{4}$$

wherein $P_{ave}$ represents an average value of PWM duty ratios, $P_N$ represents the N-th sampled value, and N represents the number of sampled values.

Then, the CPU 21 stores the average value ($P_{ave}$) in the RAM 23 (step S710). Thus, derivation of the assist torque for one process speed is completed.

Then, the CPU 21 determines whether or not the assist torque is required to be derived for another process speed (step S711), and if derivation of the assist torque therefor is required (YES to the step S711), the steps S702 to S710 are repeated. On the other hand, if derivation of the assist torque has been completed for all the process speeds, and hence no further derivation of the assist torque is required (NO to the step S711), the CPU 21 terminates the assist torque-deriving process.

According to the process in FIG. 17, the duty ratio (P) at a predetermined process speed is sampled a plurality of times, and an average value of sampled duty ratios is calculated. As a consequence, it is possible to accurately derive the duty ratio (P) for the predetermined process speed, i.e. the assist torque for offsetting the load torque.

The present embodiment provides the same advantageous effects as provided by the first embodiment.

Next, a description will be given of a third embodiment of the present invention. In the first and second embodiments, the description has been given of the configuration in which the photosensitive drums 100 are friction-driven by the intermediate transfer belt 108. In the third embodiment of the present invention, the drive-driven relationship is reversed.

Figure 18:
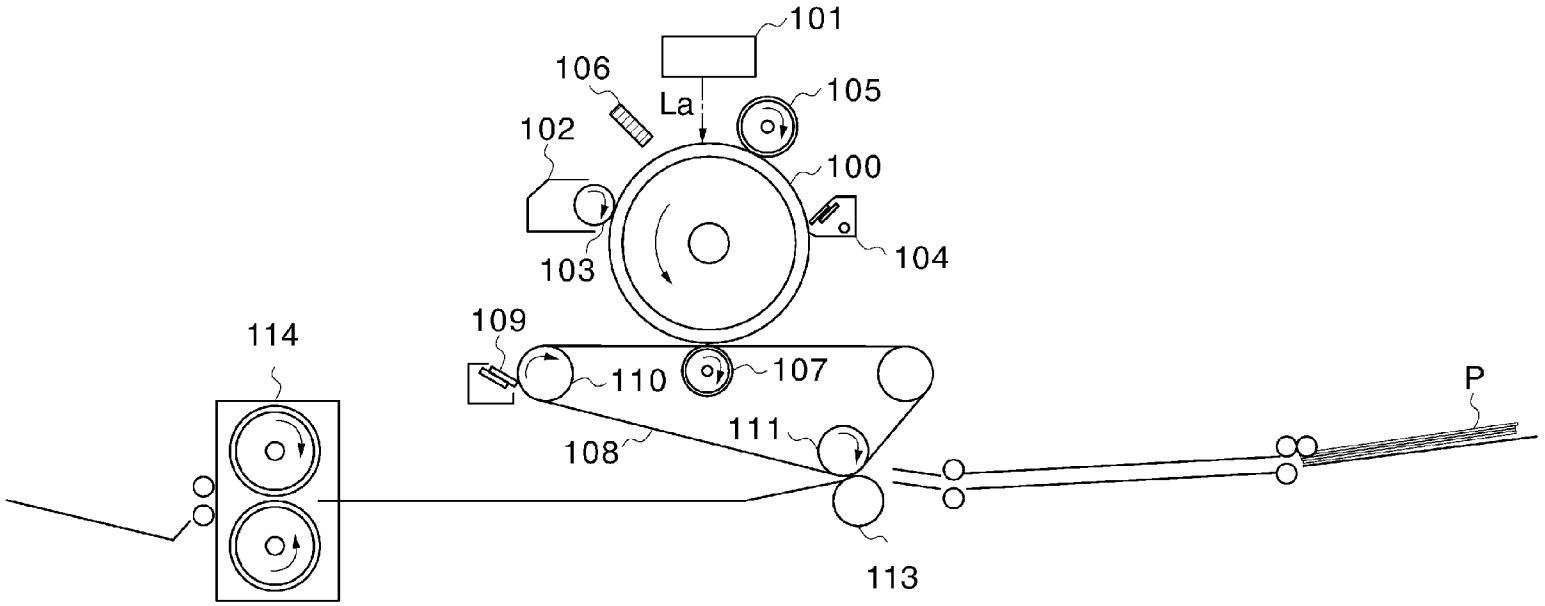
FIG. 18 is a schematic cross-sectional view of essential parts of an image forming apparatus according to a third embodiment of the present invention.

FIG. 18 is a schematic cross-sectional view of essential parts of an image forming apparatus according to the third embodiment.

As an example of the present image forming apparatus, an electrophotographic monochrome image forming apparatus having one drum is illustrated. The basic configuration of this image forming apparatus is the same as that of the image forming apparatus according to the first embodiment except that the image forming apparatus does not have four drums but has one drum. The intermediate transfer belt 108 is friction-driven by the single photosensitive drum 100.

This friction drive system can be realized by arranging only one drum. A method of realizing friction driving is the same as that described in the first embodiment, and it is only required to have the drive-driven relationship between the intermediate transfer belt 108 and the single photosensitive drum 100 inverted from that described in the first embodiment.

More specifically, the CPU 21 determines assist torque for offsetting the constant component of load torque on the drive roller 110. Then, the CPU 21 controls the photosensitive drum 100 to rotate at a constant speed and controls the BLDC motor 130 to generate the assist torque.

Figure 16:
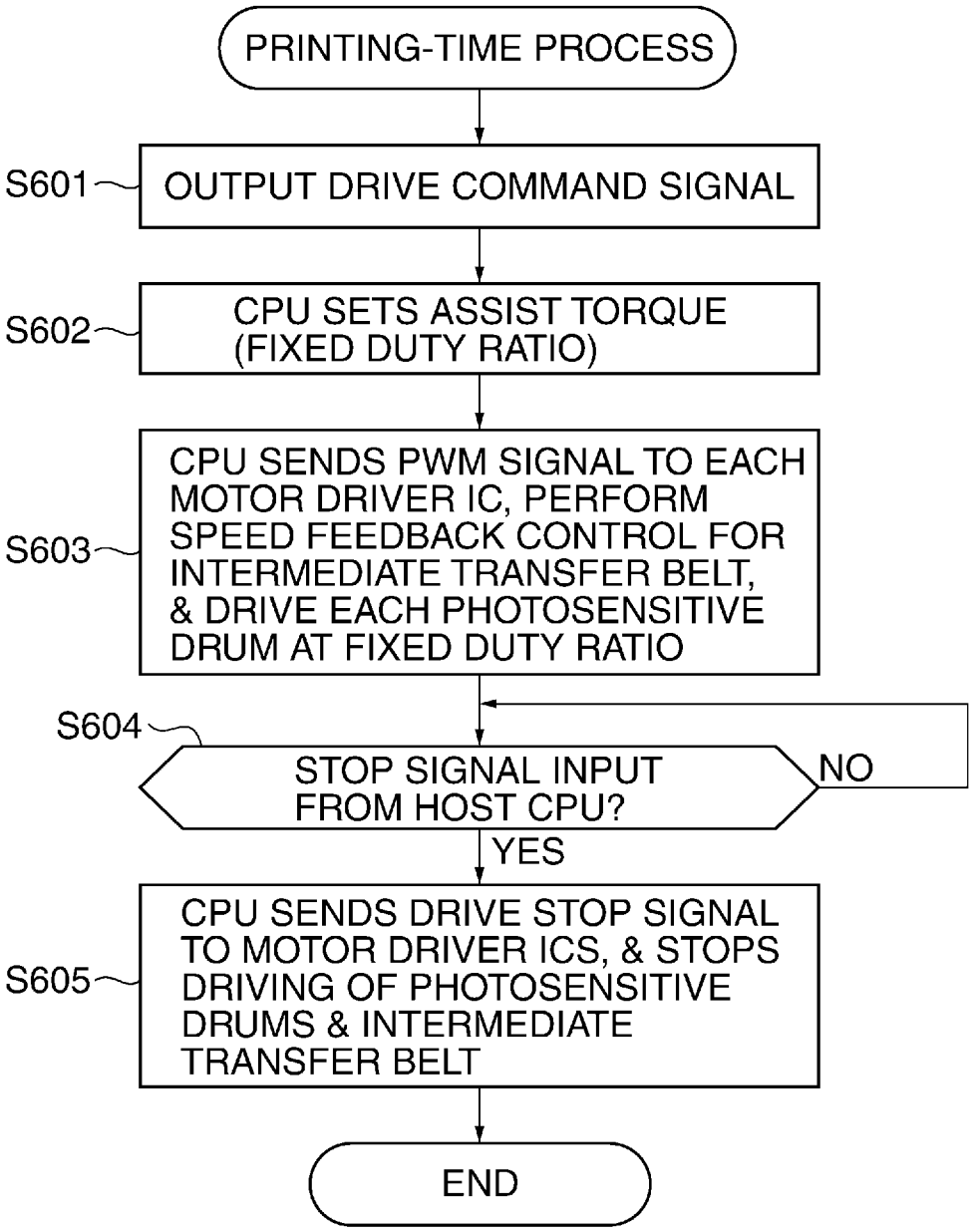
FIG. 16 is a flowchart of a printing-time process.

The method of deriving the assist torque is realized by similarly applying the method to the intermediate transfer belt 108, which is applied to the photosensitive drums 100 in the first embodiment (see FIGS. 14 to 16). Then, the duty ratio for generating the optimum assist torque is recorded in the RAM 23.

In the print operation, the host CPU 10 forms a toner image on the photosensitive drum 100 by the sub-scanning synchronized exposure in synchronism with detection of a surface position on the photosensitive drum 100. Then, during the image formation period (at least during the primary transfer of the toner image), the CPU 21 of the controller 20 performs feedback control based on the detection result from the rotary encoder 40 so as to rotate the photosensitive drum 100 at a constant surface speed. Also, the CPU 21 performs control such that the intermediate transfer belt 108 is friction-driven by the photosensitive drum 100 using the frictional force generated between the intermediate transfer belt 108 and the photosensitive drum 100. In doing this, the CPU 21 sends the PWM signal at the duty ratio for causing the BLDC motor 130 to generate the optimum assist torque, to the motor driver IC 124. That is, the CPU 21 controls the BLDC motor 130 to generate assist torque applied to the intermediate transfer belt 108 such that the friction state between the photosensitive drums 100K and the intermediate transfer belt 108 is set to the static friction state.

According to the present embodiment, assist torque for offsetting the load torque acting on the drive roller 110 is applied to the drive roller 110. This makes it possible to cause the intermediate transfer belt 108 to be friction-driven by the photosensitive drum 100 using the friction torque between the photosensitive drum 100 and the intermediate transfer belt 108. Therefore, it is possible to rotate the photosensitive drum 100 and the intermediate transfer belt 108 at the same surface speed without increasing the transfer pressure applied for the primary transfer. This makes it possible to provide the same advantageous effects as provided by the first embodiment: a high-quality image is formed by preventing occurrence of positional displacement between transferred toner images, color shift due to the positional displacement, and banding which is periodical positional displacement.

Note that in the above-described embodiments, the values (duty ratios) of the assist torque set in the step S602 in FIG. 16, the step S301 in FIG. 13, and the step S401 in FIG. 15 are values recorded in the ROM 22 or the RAM 23. However, immediately after the power is turned on e.g. before the shipment or after the shipment, the duty ratios recorded in the ROM 22 may be copied in the RAM 23. This enables the CPU 21 to always read out the duty ratios from the RAM 23 in the steps S602, S301, and S401. Alternatively, by providing a nonvolatile memory in which data can be read and written, in place of the RAM 23, both of the values of the duty ratios recorded in advance and the values updated thereafter may be recorded in the nonvolatile memory.

The assist torque deriving process in FIG. 12 may be executed at a desired timing, and for example, the process may be executed when an instruction from the user is received.

Although the assist torque is set to such a value that exactly offsets the constant component of the load torque, the assist torque is only required to be decided based on the constant component. For example, even when the assist torque is set to a value which is smaller than the constant component, it is possible, depending on a combination with the setting of the transfer pressure applied for the primary transfer, to rotate the photosensitive drum 100 and the intermediate transfer belt 108 at the same surface speed such that the friction state between the photosensitive drum 100 and the intermediate transfer belt 108 is set to the static friction state.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2012-274575, filed Dec. 17, 2012, and No. 2012-279466, filed Dec. 21, 2012 which are hereby incorporated by reference herein in their entirety.

What is claimed is:

1. An image forming apparatus comprising:

an image bearing member configured to be rotatable;

an intermediate transfer member configured to be rotatable in contact with said image bearing member;

a first drive unit configured to drive said image bearing member for rotation;

a second drive unit configured to drive said intermediate transfer member for rotation; and a control unit configured to control said first drive unit and said second drive unit, wherein said control unit performs control so that said first drive unit is caused to apply torque to said image bearing member, for offsetting load torque acting on said image bearing member, to thereby cause said image bearing member to be friction-driven by said intermediate transfer member, and wherein said control unit controls said first drive unit to apply an assist torque to said image bearing member, for setting a friction state between said image bearing member and said intermediate transfer member when said image bearing member is friction-driven by said intermediate transfer member to a static friction state.

2. The image forming apparatus according to claim 1, further comprising:

a position detection unit configured to detect a position on a surface of said image bearing member; and an exposure unit configured to form an electrostatic latent image on the surface of said image bearing member, wherein said exposure unit exposes the surface of said image bearing member in synchronism with a surface position on said image bearing member, detected by said position detection unit.

3. The image forming apparatus according to claim 1, wherein the load torque is an average value of values of load torque generated on said first drive unit to rotate said image bearing member during image formation.

4. The image forming apparatus according to claim 3, wherein the load torque does not include friction torque generated between contact surfaces of said image bearing member and said intermediate transfer member during image formation.

5. The image forming apparatus according to claim 1, wherein said first drive unit is a low-inertia DC motor.

6. The image forming apparatus according to claim 1, further comprising:

a speed detection unit configured to detect a surface speed of said image bearing member; and a decision unit configured to decide a value of the assist torque, wherein when said intermediate transfer member is caused to rotate at a constant surface speed while causing said intermediate transfer member and said image bearing member to be brought into contact with each other, and said image bearing member is friction-driven by said intermediate transfer member using a frictional force between said image bearing member and said intermediate transfer member, said decision unit increases and decreases torque generated by said first drive unit to thereby determine two values of the torque generated by said first drive unit when the surface speed of said image bearing member detected by said speed detection unit changes, and decides a torque value between the determined two torque values as a value of the assist torque.

7. The image forming apparatus according to claim 6, further comprising:

a storage unit configured to store a value of the assist torque in advance, wherein said control unit uses, as the assist torque, the value stored in said storage unit, in a case where the value of the assist torque has not been decided by said decision unit, and the value decided by said decision unit, in a case where the value of the assist torque has been decided by said decision unit.

8. The image forming apparatus according to claim 6, wherein said decision unit decides a median value between the two determined torque values as the value of the assist torque.

9. The image forming apparatus according to claim 6, wherein said decision unit determines values of the torque generated by said first drive unit when the surface speed of said image bearing member detected by said speed detection unit deviates from the constant surface speed of said intermediate transfer member by a predetermined amount or larger, as the two torque values.

10. The image forming apparatus according to claim 1, wherein a plurality of surface speeds is set as a constant surface speed of said intermediate transfer member in transferring a toner image, and the assist torque is set for each of the plurality of surface speeds.

11. The image forming apparatus according to claim 1, wherein a magnitude of the assist torque is set based on a magnitude of a constant component obtained by excluding transient varying components from the load torque during rotation of said image bearing member.

12. An image forming apparatus comprising:

an image bearing member configured to be rotatable;

an intermediate transfer member configured to rotatable in contact with said image bearing member;

a first drive unit configured to drive said image bearing member for rotation;

a second drive unit configured to drive said intermediate transfer member for rotation; and a control unit configured to control said first drive unit and said second drive unit, wherein said control unit performs control so that said second drive unit is caused to apply torque to said intermediate transfer member, for offsetting load torque acting on said intermediate transfer member, to thereby cause said intermediate transfer member to be friction-driven by said image bearing member, and wherein said control unit controls said second drive unit to apply an assist torque to said intermediate transfer member, for setting a friction state between said image bearing member and said intermediate transfer member when said intermediate transfer member is friction-driven by said image bearing member to a static friction state.

13. The image forming apparatus according to claim 12, further comprising:

a position detection unit configured to detect a position on a surface of said image bearing member; and an exposure unit configured to form an electrostatic latent image on the surface of said image bearing member, wherein said exposure unit exposes the surface of said image bearing member in synchronism with a surface position on said image bearing member, detected by said position detection unit.

14. The image forming apparatus according to claim 12, wherein the load torque is an average value of values of load torque generated on said second drive unit to rotate said intermediate transfer member during image formation.

15. The image forming apparatus according to claim 14, wherein the load torque does not include friction torque generated between contact surfaces of said image bearing member and said intermediate transfer member during image formation.

16. The image forming apparatus according to claim 12, wherein said second drive unit is a low-inertia DC motor.

17. The image forming apparatus according to claim 12, further comprising:

a speed detection unit configured to detect a surface speed of said intermediate transfer member; and a decision unit configured to decide a value of the assist torque, wherein when said image bearing member is caused to rotate at a constant surface speed while causing said image bearing member and said intermediate transfer member to be brought into contact with each other, and said intermediate transfer member is friction-driven by said image bearing member using a frictional force between said image bearing member and said intermediate transfer member, said decision unit increases and decreases torque generated by said second drive unit to thereby determine two values of the torque generated by said second drive unit when the surface speed of said intermediate transfer member detected by said speed detection unit changes, and decides a torque value between the determined two torque values as a value of the assist torque.

18. The image forming apparatus according to claim 17, further comprising:

a storage unit configured to store a value of the assist torque in advance, wherein said control unit uses, as the assist torque, the value stored in said storage unit, in a case where the value of the assist torque has not been decided by said decision unit, and the value decided by said decision unit, in a case where the value of the assist torque has been decided by said decision unit.

19. The image forming apparatus according to claim 17, wherein said decision unit decides a median value between the two determined torque values as the value of the assist torque.

20. The image forming apparatus according to claim 17, wherein said decision unit determines values of the torque generated by said second drive unit when the surface speed of said intermediate transfer member detected by said speed detection unit deviates from the constant surface speed of said image bearing member by a predetermined amount or larger, as the two torque values.

21. The image forming apparatus according to claim 12, wherein a plurality of surface speeds is set as a constant surface speed of said image bearing member in transferring a toner image, and the assist torque is set for each of the plurality of surface speeds.

22. The image forming apparatus according to claim 12, wherein a magnitude of the assist torque is set based on a magnitude of a constant component obtained by excluding transient varying components from the load torque during rotation of said intermediate transfer member.

* * * * *